US007088325B2

(12) United States Patent
Ishii

(10) Patent No.: US 7,088,325 B2
(45) Date of Patent: Aug. 8, 2006

(54) METHOD AND CIRCUIT FOR DRIVING ELECTRO-OPTICAL DEVICE, ELECTRO-OPTICAL DEVICE, AND ELECTRONIC APPARATUS

(75) Inventor: Ryo Ishii, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 319 days.

(21) Appl. No.: 09/946,852

(22) Filed: Sep. 6, 2001

(65) Prior Publication Data

US 2002/0036611 A1 Mar. 28, 2002

(30) Foreign Application Priority Data

Sep. 6, 2000 (JP) ..... 2000-270424

(51) Int. Cl.
*G09G 3/36* (2006.01)

(52) U.S. Cl. ..... 345/89; 345/90; 359/245

(58) Field of Classification Search ..... 345/690, 345/98, 99, 100, 89, 90, 93, 96, 94, 84, 92, 345/85, 87; 349/33, 85, 151, 37; 257/347; 359/255, 254, 245; 315/169.1
See application file for complete search history.

(56) References Cited

U.S. PATENT DOCUMENTS 5,436,662 A * 7/1995 Nagasaki et al. ..... 348/312
5,764,212 A * 6/1998 Nishitani et al. ..... 345/98
5,798,746 A 8/1998 Koyama
6,005,558 A 12/1999 Hudson et al.
6,229,583 B1 * 5/2001 Yasunishi ..... 349/33
6,456,267 B1 * 9/2002 Sato et al. ..... 345/92
6,496,170 B1 * 12/2002 Yoshida et al. ..... 345/87
6,498,369 B1 * 12/2002 Yamazaki et al. ..... 257/347
6,552,706 B1 * 4/2003 Ikeda et al. ..... 345/96
6,577,295 B1 * 6/2003 Kikkawa ..... 345/92
6,628,253 B1 * 9/2003 Hiroki ..... 345/87
6,670,938 B1 * 12/2003 Yoshida ..... 345/98

FOREIGN PATENT DOCUMENTS

EP 0 488 891 A2 6/1992
EP 1 020 840 A1 7/2000

(Continued)

*Primary Examiner*—Richard Hjerpe
*Assistant Examiner*—Abbas Abdulselam
(74) *Attorney, Agent, or Firm*—Oliff & Berridge, PLC

(57) ABSTRACT

The invention provides an electro-optical device capable of performing high-quality and high-definition gray-scale display, which can be driven with a low power consumption, and to provide a driving method therefor and an electronic apparatus using the electro-optical device. An electro-optical device according to the present invention includes a plurality of pixels. Each pixel includes a pixel electrode, a memory that stores gray-scale data, and a pulse duration control circuit that applies, to the pixel, a voltage that turns on the pixel or a voltage that turns off the pixel with a time density in accordance with the gray-scale data written to the memory. According to the electro-optical device, by turning on or off each pixel, gray-scale display can be performed by effective value control. From among a plurality of pixels, it is only necessary to write gray-scale data to the memory of a pixel whose gray-scale data written to the memory thereof needs to be changed. Thus, display can be performed with a low power consumption.

47 Claims, 17 Drawing Sheets

FOREIGN PATENT DOCUMENTS

| | | |
|---|---|---|
| EP | 1 091 342 A2 | 4/2001 |
| JP | A 59-208588 | 11/1984 |
| JP | A 04-195188 | 7/1992 |
| JP | A 06-102486 | 4/1994 |
| JP | A 07-301782 | 11/1995 |
| JP | A 09-212140 | 8/1997 |
| JP | 9-243994 A | 9/1997 |
| KR | A 1999-008611 | 2/1999 |

* cited by examiner

| D2 | D1 | D0 | P0 | P1 | P2 |
|---|---|---|---|---|---|
| | | | H | L | L |
| | | | L | H | L |
| | | | L | L | H |
| L | L | L | L | L | L |
| L | L | H | H | L | L |
| L | H | L | L | H | L |
| L | H | H | H | H | L |
| H | L | L | L | L | H |
| H | L | H | H | L | H |
| H | H | L | L | H | H |
| H | H | H | H | H | H |

Fig. 9

| | | | | | | | | | |
|---|---|---|---|---|---|---|---|---|---|
| | | | | P0 | H | L | H | L | H | L | H |
| | | | | P1 | L | H | H | L | L | H | H |
| | | | | P2 | L | L | L | H | H | H | H |
| D2 | D1 | D0 | VALUE | VALUE | 1 | 2 | 3 | 4 | 5 | 6 | 7 |
| L | L | L | 0 | | L | L | L | L | L | L | L |
| L | L | H | 1 | | H | L | L | L | L | L | L |
| L | H | L | 2 | | H | H | L | L | L | L | L |
| L | H | H | 3 | | H | H | H | L | L | L | L |
| H | L | L | 4 | | H | H | H | H | L | L | L |
| H | L | H | 5 | | H | H | H | H | H | L | L |
| H | H | L | 6 | | H | H | H | H | H | H | L |
| H | H | H | 7 | | H | H | H | H | H | H | H |

| | | | P0 | L | H | L | H | L | H | L | H |
|---|---|---|---|---|---|---|---|---|---|---|---|
| | | | P1 | L | L | H | H | L | L | H | H |
| | | | P2 | L | L | L | L | H | H | H | H |
| D2 | D1 | D0 | | | | | | | | | |
| L | L | L | | L | L | L | L | L | L | L | L |
| L | L | H | | L | H | L | L | L | L | L | L |
| L | H | L | | L | H | H | L | L | L | L | L |
| L | H | H | | L | H | H | H | L | L | L | L |
| H | L | L | | L | H | H | H | H | L | L | L |
| H | L | H | | L | H | H | H | H | H | L | L |
| H | H | L | | L | H | H | H | H | H | H | L |
| H | H | H | | L | H | H | H | H | H | H | H |

METHOD AND CIRCUIT FOR DRIVING ELECTRO-OPTICAL DEVICE, ELECTRO-OPTICAL DEVICE, AND ELECTRONIC APPARATUS

BACKGROUND OF THE INVENTION

1. Field of Invention

The present invention relates to electro-optical devices capable of performing gray-scale display, to methods and circuits for driving the same, and to electronic apparatuses.

2. Description of Related Art

Electro-optical devices, such as liquid crystal displays using liquid crystal as an electro-optical material, are widely used as display devices in place of cathode-ray tubes (CRTs) in displays of various information processing apparatus, wall-mounted televisions, and the like.

By way of example, a conventional electro-optical device has the following structure. Specifically, the conventional electro-optical device typically includes a device substrate on which pixel electrodes aligned in the form of a matrix and switching devices, such as TFTs (Thin Film Transistors) connected to the pixel electrodes, are provided, an opposing substrate on which counter electrodes opposed to the pixel electrodes are formed, and liquid crystal, i.e., electro-optical material, filled between the two substrates. With this arrangement, when a scanning signal is supplied to the switching devices via scanning lines, the switching devices become conducting. In this conducting state, when an image signal with a voltage, in accordance with a gray level, is supplied to the pixel electrodes through data lines, a charge in accordance with the voltage of the image signal is accumulated in a liquid crystal layer between the pixel electrodes and the counter electrodes. When the switching devices enter an off-state, after the charge has been accumulated, the accumulated charge in the liquid crystal layer is maintained by the capacitance of the liquid crystal layer and by storage capacitors. Accordingly, when the switching devices are driven so as to control the amount of charge that is accumulated in accordance with the gray level, alignment of the liquid crystal varies according to each pixel, that is, the gray level varies according to each pixel. As a result, gray-scale display can be performed.

It is only necessary to accumulate charge in the liquid crystal layer of each pixel for a partial period. First, a scanning-line driving circuit sequentially selects each scanning line. Second, a data-line driving circuit sequentially selects each data line within the scanning-line selection period. Third, an image signal with a voltage in accordance with a gray level is sampled on the selected data line. As a result, time-division multiplexing driving in which the scanning line and the data line are shared by a plurality of pixels is made possible.

An image signal supplied to the data line is a voltage in accordance with the gray level, that is, an analog signal. It is necessary to provide a D/A converter circuit and an operational amplifier in peripheral circuits of the electro-optical device. This causes an increase in the cost of the overall device. In addition, display unevenness is caused by nonuniformity in characteristics of the D/A converter circuit and the operational amplifier and by nonuniformity in various wiring resistances. It is therefore difficult to perform high-quality display. In particular, this problem becomes noticeable in performing high-definition display.

In the above-described conventional electro-optical device, it is necessary to apply the image signal to all pixels at predetermined time intervals. Specifically, it is necessary to sequentially select all the scanning lines by the scanning-line driving circuit at predetermined time intervals. Also, it is necessary to apply the image signal with a voltage in accordance with the gray level, to all data lines, in every selection period. As a result, the power consumption is increased. In particular, this problem becomes noticeable when the number of pixels to which the image signal is applied, is increased in order to enhance the resolution. Although various techniques have been implemented in order to reduce the power consumption, it is still necessary to apply the image signal to all the pixels at predetermined time intervals. In the present circumstances, there is a limit to lowering the power consumption.

SUMMARY OF THE INVENTION

In view of the above problems, it is an object of the present invention to provide an electro-optical device capable of performing high-quality and high-definition gray-scale display, which can be driven with a low power consumption, and to provide a method and circuit for driving the same and an electronic apparatus using the same.

In order to solve the foregoing problems, a first aspect of the invention is a method for driving an electro-optical device which includes a plurality of pixels, each including a k-bit memory (where k is a natural number 1, 2, 3, . . . ) and which performs k-bit gray-scale display, in accordance with k-bit gray-scale data. The gray-scale data, is written to the memory of each pixel. A pulse signal, with a time density in accordance with the gray-scale data, is generated based on the gray-scale data written to the memory and k-bit gray-scale signals. One of a voltage that turns on the pixel or a voltage that turns off the pixel, is applied to the pixel in accordance with the pulse signal.

According to the first aspect of the invention, each pixel is turned on or off with a time density in accordance with the gray-scale data. As a result, gray-scale display by effective value control is performed. In other words, since gray-scale display is implemented only by turning on or off each pixel, display unevenness due to nonuniformity in device characteristics and wiring resistances does not occur. As a result, it is possible to perform high-quality and high-definition gray-scale display.

Furthermore, according to the first aspect of the invention, it is unnecessary to supply gray-scale data to all of the pixels every predetermined period of time, (such as every field) since each pixel has a memory and each pixel is turned on or off with a time density, in accordance with the gray-scale data stored in the memory. In other words, gray-scale display can be implemented only by writing the gray-scale data to a pixel when the gray-scale data thereof is changed. Thus, compared with an electro-optical device that supplies the gray-scale data to all of the pixels every predetermined period of time, the power consumption can be reduced significantly.

In the present invention, one field is used in the context of a period which is conventionally required to form one raster image by performing horizontal scanning and vertical scanning in synchronization with a horizontal-scan signal and a vertical-scan signal. It should thus be noted that one frame in non-interlaced mode also corresponds to one field in the present invention.

According to the present invention, concerning the k-bit gray-scale signals, a selection period of each bit may be set to a time density which implements gray-scale display with $2^0, 2^1, 2^2, \ldots, 2^{k-1}$ levels. Furthermore, the gray-scale signal of the corresponding bit may be selected from among the gray-scale signals in accordance with the gray-scale data, and the pulse signal may be generated by combining the selection periods of the selected gray-scale signals. One of the voltage that turns on the pixel or the voltage that turns off the pixel, may be applied to the pixel electrode in accordance with the pulse signal. Accordingly, in addition to pulse signals with time densities of $2^0$, $2^1$, $2^2$, . . . , $2^{k-1}$, it is possible to generate a pulse signal having an arbitrary time density of k bits, by combining selection periods of gray-scale signals in accordance with gray-scale data. The pixel is turned on or off in accordance with the time density of the pulse signal, thereby implementing gray-scale display by effective value control.

According to the first aspect of the invention, the k-bit gray-scale signals may be output signals from a k-bit counter. A period in which each counter value that is indicated by the output signals is maintained, may be set to the time density with which k-bit gray-scale display is implemented. Furthermore, the k-bit gray-scale data may be compared with a k-bit counter value based on the gray-scale signals, and the pulse signal may be generated in accordance with the comparison result. In accordance with the pulse signal, one of the voltage that turns on the pixel or the voltage that turns off the pixel may be applied to the pixel electrode. Accordingly, it is possible to generate a pulse signal with an arbitrary time density of k bits, by arbitrarily setting the time density of each k-bit counter value in accordance with gray-scale characteristics of an electro-optical material and by comparing the gray-scale data with the counter value. The pixel is turned on or off in accordance with the time density of the pulse signal, thereby implementing gray-scale display by effective value control.

According to the first aspect of the invention, the pixel may be turned off regardless of a value of the gray-scale data during a period in which the gray-scale signals have a predetermined value. Accordingly, for example, when an electro-optical material, having a characteristic that transmissivity decreases when an applied effective voltage, exceeds a predetermined value is used, it is still possible to reliably obtain desired transmissivity by appropriately setting the time density of a period in which the predetermined value is obtained.

According to the aspect of the first invention, the pixel may include the pixel electrode and a counter electrode which is opposed to the pixel electrode and to which a reference voltage, whose polarity is inverted every predetermined period is applied. Preferably, in accordance with the pulse signal, when turning on the pixel, a voltage, which is the opposite polarity as the reference voltage, is applied to the pixel electrode, and, when turning off the pixel, a voltage which is the same polarity as reference voltage, is applied to the pixel electrode. Accordingly, the polarity of a voltage applied to the pixel can be inverted every predetermined period. In other words, it is possible to prevent application of a direct current (DC) component to the electro-optical material. Thus, deterioration of the electro-optical material can be prevented.

According to the aspect of the first invention, the pixel may include the pixel electrode and a counter electrode which is opposed to the pixel electrode and to which a predetermined reference voltage is applied. In accordance with the pulse signal, when turning off the pixel, a voltage, the same as the reference voltage, may be applied to the pixel electrode, and, when turning on the pixel, one of a first voltage, higher than the reference voltage, or a second voltage, lower than the reference voltage, may be applied to the pixel electrode, while switching between the first and second voltages with a predetermined period. In such cases, it is possible to prevent application of a DC component to the electro-optical material. Thus, deterioration of the electro-optical material can be prevented.

When performing such alternating current (AC) driving, the predetermined period may differ from the period of each field. Accordingly, it is possible to arbitrarily set the polarity inversion period of a voltage applied to the pixel, to a period in which the least amount of flicker is generated.

According to the first aspect of the invention, from among the plurality of pixels, the gray-scale data may be written only to the memory of the pixel whose gray-scale data stored in the memory thereof needs to be changed. This makes it unnecessary to write gray-scale data to a pixel whose gray-scale data remains unchanged. Compared with a conventional electro-optical device in which the gray-scale data is written to all of the pixels, every predetermined period of time, the power used to perform driving can be significantly reduced.

In order to solve the foregoing problems, a second aspect of the invention is a driving circuit for an electro-optical device, including a plurality of groups of column selection lines in which the number of column selection lines is k (where k is a natural number 1, 2, 3, . . . ), a plurality of row selection lines, and a plurality of pixels which are formed corresponding to intersections of the column selection lines and the row selection lines, each pixel including a k-bit memory that stores k-bit gray-scale data. A pulse signal, with a time density in accordance with the gray-scale data, is generated based on the gray-scale data written to the memory and k-bit gray-scale signals, and one of a voltage that turns on the pixel or a voltage that turns off the pixel, is applied to the pixel in accordance with the pulse signal. The driving circuit includes a row-selection-line driving circuit that supplies a selection signal to the row selection line that corresponds to the pixel to which the gray-scale data is to be written; and a column-selection-line driving circuit that supplies a signal that corresponds to each bit of the gray-scale data to each column selection line which forms the group of column selection lines corresponding to the pixel to which the gray-scale data is to be written, while the selection signal is being supplied to the row selection line.

With this arrangement, gray-scale display is implemented by handling gray-scale data as digital data. Display unevenness due to nonuniformity in device characteristics and wiring resistances does not occur. As a result, high-quality and high-definition gray-scale display can be performed.

The driving circuit may further include a gray-scale signal generating circuit that generates the gray-scale signals. Accordingly, peripheral circuits can be simplified, and the cost can be reduced.

According to the second aspect of the invention, a selection period of each bit of the k-bit gray-scale signals may be set to a time density which implements gray-scale display with $2^0$, $2^1$, $2^2$, . . . , $2^{k-1}$ levels. Accordingly, in addition to pulse signals with time densities of $2^0$, $2^1$, $2^2$, . . . , $2^{k-1}$, it is possible to generate a pulse signal having an arbitrary time density of k bits, by combining the selection periods of the gray-scale signals in accordance with the gray-scale data. The pixel is turned on or off in accordance with the time density of the pulse signal, thereby implementing gray-scale display by effective value control.

According to the second aspect of the invention, the k-bit gray-scale signals may be output signals from a k-bit counter, and a period in which each counter value indicated by the output signals is maintained, may be set to the time density with which k-bit gray-scale display is implemented. Accordingly, it is possible to generate a pulse signal with an arbitrary time density of k bits, by arbitrarily setting a time density of each k-bit counter value in accordance with gray-scale characteristics of an electro-optical material and by comparing the gray-scale data with the counter value. The pixel is turned on or off in accordance with the time density of the pulse signal, thereby implementing gray-scale display by effective value control.

According to the second aspect of the invention, the pixel may be turned off regardless of a value of the gray-scale data during a period in which the gray-scale signals have a predetermined value. Accordingly, for example, when an electro-optical material having a characteristic that transmissivity decreases when an applied effective voltage exceeds a predetermined value is used, it is still possible to reliably obtain desired transmissivity by appropriately setting the time density of a period in which the predetermined value is obtained.

According to the second aspect of the invention, the row-selection-line driving circuit and the column-selection line driving circuit may be formed on a predetermined substrate on which the pixels are formed. Accordingly, peripheral circuits can be simplified, and the cost can be reduced.

According to the second aspect of the invention, it is preferable that a writing circuit be provided that writes the gray-scale data only to the memory of the pixel, from among the pixels, whose gray-scale data stored in the memory thereof needs to be changed. Accordingly, it is unnecessary to supply the gray-scale data to all of the pixels every predetermined period of time. Compared with a conventional electro-optical device that supplies the gray-scale data to all of the pixels every predetermined period of time, the power used to perform driving can be significantly reduced.

According to the second aspect of the invention, it is preferable that the structure further include, a reading circuit that reads the gray-scale data stored in the memory of the pixel. Accordingly, it is unnecessary to provide a controller which supplies gray-scale data and the like with a memory that stores gray-scale data for each pixel.

In order to solve the foregoing problems, a third aspect of the invention is an electro-optical device which includes a plurality of pixels and which performs k-bit gray-scale display in accordance with k-bit gray-scale data (where k is a natural number 1, 2, 3, . . . ). The electro-optical device includes a plurality of groups of column selection lines, in which the number of column selection lines is k; a plurality of row selection lines; a plurality of pixels formed corresponding to intersections of the column selection lines and the row selection lines. Each pixel includes a pixel electrode, a k-bit memory that stores the k-bit gray-scale data, and a pixel driving circuit that generates a pulse signal with a time density in accordance with the gray-scale data, based on the gray-scale data written to the memory and k-bit gray-scale signals and that applies one of a voltage that turns on the pixel or a voltage that turns off the pixel, to the pixel electrode; a row-selection-line driving circuit that supplies a selection signal to the row selection line that corresponds to the pixel to which the gray-scale data is to be written; and a column-selection-line driving circuit that supplies the gray-scale data to each column selection line which forms the group of column selection lines corresponding to the pixel to which the gray-scale data is to be written, while the selection signal is being supplied to the row selection line.

According to the third aspect of the invention, each pixel is turned on or off with a time density in accordance with the gray-scale data. As a result, gray-scale display by effective value control is performed. In other words, since gray-scale display is implemented only by turning on or off each pixel, display unevenness due to nonuniformity in device characteristics and wiring resistances does not occur. As a result, it is possible to perform high-quality and high-definition gray-scale display.

According to the third aspect of the invention, each pixel includes the memory, and each pixel is turned on or off with a time density in accordance with the gray-scale data stored in the memory. As a result, it is unnecessary to supply the gray-scale data to all of the pixels every predetermined period of time (such as every field) since each pixel has a memory and each pixel is turned on or off with a time density in accordance with the gray-scale data stored in the memory. In other words, gray-scale display can be implemented only by writing the gray-scale data to a pixel, when the gray-scale data thereof is changed. Thus, compared with an electro-optical device for supplying the gray-scale data to all of the pixels every predetermined period of time, it is an advantage that the power consumption can be reduced significantly.

The foregoing advantage becomes particularly noticeable when using a so-called static memory, that is, when the memory includes a switching device which is turned on by the selection signal; and two inverters that write the gray-scale data which is supplied to the corresponding column selection line, when the switching device is turned on and that maintains the written gray-scale data when the switching device is turned off, wherein the output of one inverter is the input of the other inverter.

The electro-optical device may further include a gray-scale signal generating circuit that generates the gray-scale signals. Accordingly, peripheral circuits can be simplified, and the cost can be reduced.

According to the third aspect of the invention, a selection period of each bit of the k-bit gray-scale signals is set to a time density which implements gray-scale display with $2^0$, $2^1$, $2^2$, . . . , $2^{k-1}$ levels. Furthermore, the pixel driving circuit may include a pulse duration control circuit that selects the gray-scale signal of the corresponding bit from among the gray-scale signals, in accordance with the gray-scale data and that generates the pulse signal by combining the selection periods of the selected gray-scale signals; and a switching circuit that applies one of the voltage that turns on the pixel or the voltage that turns off the pixel, to the pixel electrode in accordance with the pulse signal generated by the pulse duration control circuit. Accordingly, in addition to pulse signals with time densities of $2^0$, $2^1$, $2^2$, . . . , $2^{k-1}$, it is possible to generate a pulse signal having an arbitrary time density of k bits, by combining the selection periods of the gray-scale signals in accordance with the gray-scale data. The pixel is turned on or off in accordance with the time density of the pulse signal, thereby implementing gray-scale display by effective value control.

According to the third aspect of the invention, the k-bit gray-scale signals may be output signals from a k-bit counter. A period in which each counter value indicated by the output signals is maintained, may be set to the time density with which k-bit gray-scale display is implemented.

Furthermore, the pixel driving circuit may include a pulse duration control circuit that compares the k-bit gray-scale data with a k-bit counter value based on the gray-scale signals and that generates the pulse signal in accordance with the comparison result; and a switching circuit that applies one of the voltage that turns on the pixel or the voltage that turns off the pixel to the pixel electrode in accordance with the pulse signal generated by the pulse duration control circuit. Accordingly, it is possible to generate a pulse signal with an arbitrary time density of k bits by arbitrarily setting the time density of each k-bit counter value in accordance with gray-scale characteristics of an electro-optical material and by comparing the gray-scale data with the counter value. The pixel is turned on or off in accordance with the time density of the pulse signal, thereby implementing gray-scale display by effective value control.

According to the third aspect of the invention, the pixel may be turned off regardless of a value of the gray-scale data during a period in which the gray-scale signals have a predetermined value. Accordingly, for example, when an electro-optical material having a characteristic that transmissivity decreases when an applied effective voltage exceeds a predetermined value is used, it is still possible to reliably obtain desired transmissivity by appropriately setting the time density of a period in which the predetermined value is obtained.

Furthermore, according to the third aspect of the invention, the row-selection-line driving circuit and the column-selection-line driving circuit may be formed on a predetermined substrate on which the pixels are formed. Accordingly, peripheral circuits can be simplified, and the cost can be reduced.

According to the third aspect of the invention, it is preferable that a writing circuit be provided that writes the gray-scale data only to the memory of the pixel, from among the pixels, whose gray-scale data stored in the memory thereof needs to be changed. Accordingly, it is unnecessary to supply the gray-scale data to all of the pixels every predetermined period of time. Compared with a conventional electro-optical device that supplies the gray-scale data to all of the pixels every predetermined period of time, the power used to perform driving can be significantly reduced.

According to the third aspect of the invention, it is preferable that the structure further include a reading circuit that reads the gray-scale data stored in the memory of the pixel. Accordingly, it is unnecessary to provide a controller which supplies the gray-scale data and the like with a memory that stores the gray-scale data supplied to each pixel.

Each of the memory and the pixel driving circuit may include a switching device. At least one of the switching devices included in the memory or the pixel driving circuit may be formed of a thin film transistor formed on an insulating substrate. When the insulating substrate is made of quartz glass or the like, a transmissive-type electro-optical device can be obtained.

Each of the memory and the pixel driving circuit may include a switching device. At least one of the switching devices included in the memory or the pixel driving circuit may be formed on a semiconductor substrate. Since the semiconductor substrate has high electron mobility, it is possible to make the switching device of the pixel driving circuit respond quickly and to reduce the size of the switching device of the pixel driving circuit.

Furthermore when the pixel electrode is made reflective, it is unnecessary to provide the electro-optical device with a light source in performing a reflective-type display. As a result, the power consumption can be greatly reduced. In such a case, it is preferable that at least one of the memory or the pixel driving circuit be formed on the opposite side to the observing side with respect to the pixel electrode. Accordingly, it becomes unnecessary to provide the memory or the pixel driving circuit between pixel electrodes. Thus, light is not blocked between pixel electrodes, and the aperture ratio of each pixel is advantageously increased.

The foregoing problems can be also solved by manufacturing or selling an electronic apparatus according to a fourth aspect of the invention, which includes the above-described electro-optical device as a display device, as well as by manufacturing or selling the above-described electro-optical device by itself. According to the electronic apparatus, because of reasons similar to those described hereinabove, it is possible to perform driving with low power consumption and to perform high-quality and high-definition gray-scale display.

BRIEF DESCRIPTION OF THE DRAWINGS

FIG. 9 is a truth table showing the operation of the pixel in the electro-optical device;

DETAILED DESCRIPTION OF PREFERRED EMBODIMENTS

With reference to the drawings, the present invention will be further illustrated using embodiments described below. The embodiments only illustrate aspects of the present invention and are not intended to limit the present invention. The embodiments can be changed within the scope of the present invention.

A: Principle of Operation of Electro-optical Device According to the Present Invention In order to make a device according to this embodiment more understandable, a method for driving an electro-optical device of this embodiment is described.

Figures 4, 5:
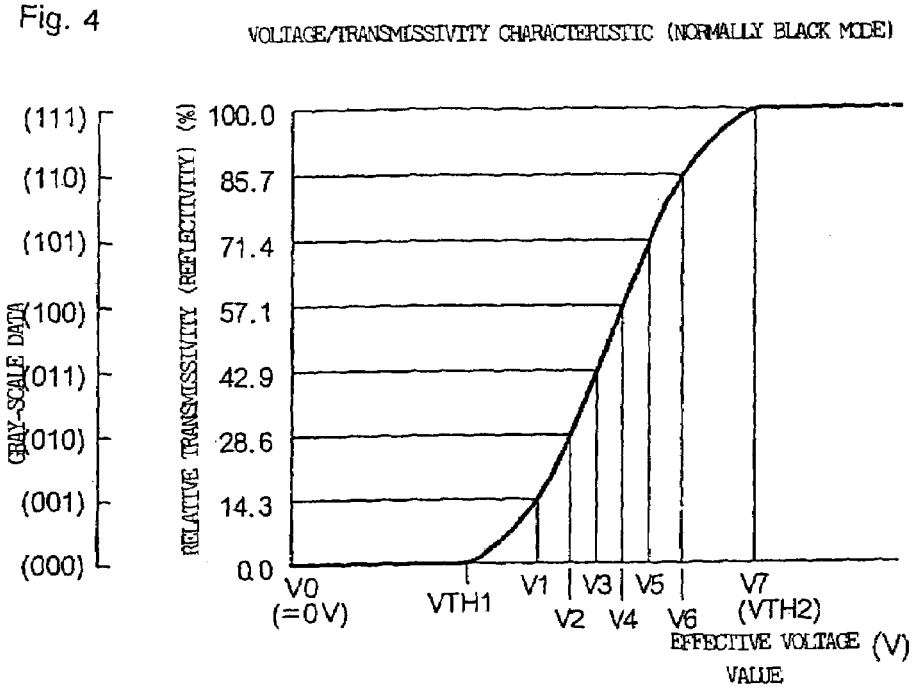
FIG. 4 is a graph of an example of a voltage/transmissivity characteristic of the liquid crystal.
FIG. 5 is a truth table showing the operation of the pixel in the electro-optical device.

In general, in liquid crystal displays which use liquid crystal as an electro-optical material, the relationship between an effective voltage value applied to the liquid crystal and relative transmissivity (or reflectivity in the case of a reflective-type liquid crystal device) in, for example, a normally black mode, in which black is displayed in the state where no voltage is applied, is shown in FIG. 4. The relative transmissivity (reflectivity) used herein is obtained by normalization in which the minimum value and the maximum value of the amount of transmitted (or reflected) light are set as 0% and 100%, respectively. As shown in FIG. 4, the transmissivity of the liquid crystal is 0%, when a voltage applied to a liquid crystal layer is less than a threshold value VTH1. When the applied voltage is greater than or equal to the threshold value VTH1, and when the applied voltage is less than or equal to a saturation voltage VTH2, the transmissivity increases nonlinearly with respect to the applied voltage. When the applied voltage is greater than or equal to the saturation voltage VTH2, the transmissivity of the liquid crystal has a constant value regardless of the applied voltage.

In order to obtain an intermediate transmissivity, between 0% and 100%, as the transmissivity of the liquid crystal, as illustrated by the voltage/transmissivity characteristic shown in FIG. 4, it is necessary to apply an effective voltage in accordance with the transmissivity between the voltage VTH1 and the voltage VTH2 to the liquid crystal layer.

In conventional techniques, voltages for obtaining such intermediate gray levels are generated by analog circuits such as a D/A converter circuit, an operational amplifier, and the like, and the generated voltages are applied to pixel electrodes. The voltages applied to the pixel electrodes using such a driving method are easily influenced by nonuniformity in characteristics of analog circuits and by nonuniformity in various wiring resistances. In addition, variations may be often caused in pixels. As a result, it is difficult to perform high-quality and high-definition gray-scale display.

In order to solve this problem, first, the electro-optical device according to this embodiment uses the following method to drive pixels.

First, one field (1*f*) is divided into a plurality of sub-fields. In units of sub-fields, a voltage is applied to the liquid crystal layer. In each sub-field, only one of voltages VH or VL (=0V) is applied to the liquid crystal layer. In this case the voltage VH is set so as to make the effective voltage value applied to the liquid crystal layer in one field greater than or equal to voltage V7 shown in FIG. 4 when applied to the liquid crystal layer in that field.

Then, the sub-fields in which the voltage VH is applied and the sub-fields in which the voltage VL is applied are determined in accordance with gray-scale data, in order that the ratio between a period in which the voltage VH is applied in one field and a period in which the voltage VL (=0V) is applied is a ratio in accordance with the gray-scale data. Accordingly, the effective voltage in accordance with the gray-scale data is applied to the liquid crystal layer, thereby performing display at intermediate gray-levels with transmissivity between 0% and 100%. The specific time period of each sub-field will be described hereinafter.

In the following embodiments, it is assumed that the electro-optical device performs 8-level gray-scale display in accordance with 3-bit gray-scale data D0, D1, and D2. However, it is understood that the present invention is not limited to these embodiments.

B: First Embodiment

B-1: Structure of First Embodiment

Figure 1:
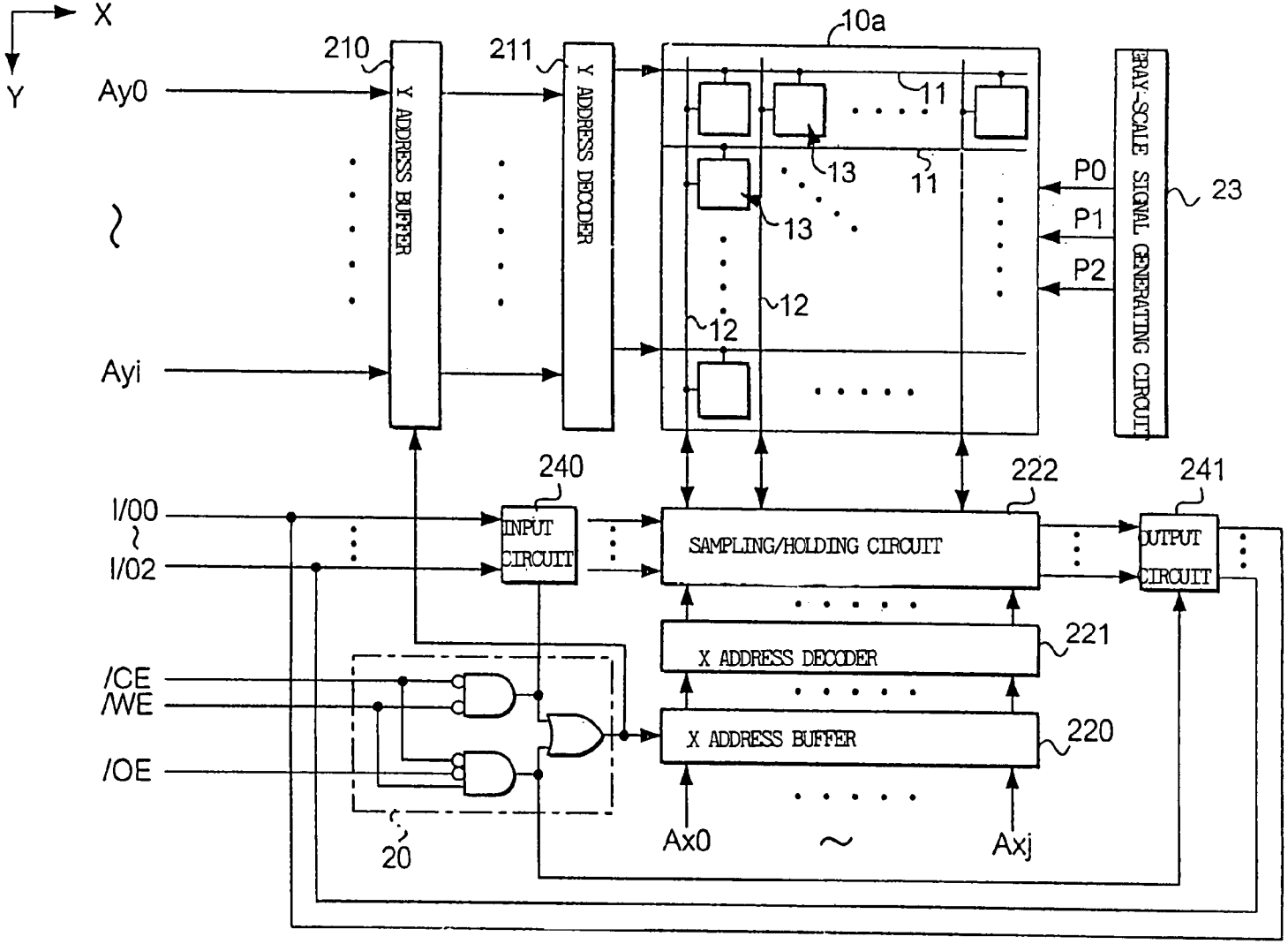
FIG. 1 is a schematic of the overall structure of an electro-optical device according to a first embodiment of the present invention.

FIG. 1 is a schematic of the electrical structure of an electro-optical device according to this embodiment. The electro-optical device is a liquid crystal device using liquid crystal as an electro-optical material. A device substrate and an opposing substrate are bonded with a predetermined gap therebetween, and the gap is filled with liquid crystal, that is, the electro-optical material. In the electro-optical device, a semiconductor substrate is used as the device substrate. On the device substrate, MOS transistors form a pixel circuit that controls display performed by each pixel and a peripheral driving circuit that controls the pixel circuit and the like. In FIG. 1, the configuration of the circuits formed on the device substrate is shown.

As shown in FIG. 1, in a display region 10*a* on the device substrate, a plurality of row selection lines 11 are formed extending in the X (row) direction. Also, a plurality of column selection lines 12 are formed extending in the Y (column) direction. Pixels 13 are formed corresponding to intersections of the row selection lines 11 and the column selection lines 12, aligned in the form of a matrix. In this embodiment, in order to simplify the description, the total number of the row selection lines 11 is m, and the total number of the column selection lines 12 is n (where m and n are integers equal to 2 or greater). Although an m×n matrix display device is described in this embodiment, the present invention is not limited to this embodiment.

In order to simplify the drawing, FIG. 1 illustrates m pixels 13 for one column, which are connected to one column selection line 12. However, the actual column selection line 12 in FIG. 1, is formed of a plurality of column selection lines (details are described hereinafter).

The electro-optical device includes an operation control circuit 20, a Y address buffer 210, a Y address decoder 211, an X address buffer 220, an X address decoder 221, a sampling/holding circuit 222, a gray-scale signal generating circuit 23, an input circuit 240, and an output circuit 241.

The operation control circuit 20 generates an internal control signal in accordance with the operation mode, based on a chip enable signal /CE, a write enable signal /WE, and an output enable signal /OE, which are supplied from a high-level device (not shown).

The specific configuration of the operation control circuit 20 is shown in FIG. 1. With this configuration, when the chip enable signal /CE and the write enable signal /WE are at the L level, an H-level enable signal is supplied to the Y address buffer 210, the X address buffer 220, and the input circuit 240. As a result, the operation control circuit 20 enters a write mode in which gray-scale data D0 to D2 supplied from the high-level device through data input/output terminals, I/O0 to I/O2, are written to each pixel 13. The entire circuit that is operated when the circuit enters the write mode corresponds to the "writing circuit" set forth in the claims.

In contrast, when the chip enable signal /CE and the output enable signal /OE are at the L level, and when the write enable signal /WE is at the H level, the H-level enable signal is supplied to the Y address buffer 210, the X address buffer 220, and the output circuit 241. As a result, the operation control circuit 20 enters a read mode in which data written to each pixel 13 is read, and the read data is output through the input/output terminals I/O0 to I/O2. The entire circuit that is operated when the circuit enters the read mode corresponds to the "reading circuit" set forth in the claims.

The input circuit 240 and the output circuit 241 are connected to the input/output terminals I/O0 to I/O2. The input circuit 240 is activated when the H-level enable signal is supplied from the operation control circuit 20. The input circuit 240 outputs gray-scale data D0 to D2 which are input through the data input/output terminals, I/O0 to I/O2, to the sampling/holding circuit 222. The gray-scale data D0 to D2 are H-level or L-level digital data. The output circuit 241 is activated when the H-level enable signal is supplied from the operation control circuit 20. The output circuit 241 outputs the gray-scale data, D0 to D2, which are read from the pixel 13 by the sampling/holding circuit 222 to the input/output terminals I/O0 to I/O2.

Y address signals, Ay0 to Ayi, are supplied from a high-level device (not shown) to the Y address buffer 210. The Y address buffer 210 is activated when the H-level enable signal is supplied from the operation control circuit 20, and outputs the Y address signals, Ay0 to Ayi, which are supplied thereto at that moment to the Y address decoder 211.

The input terminals of the Y address decoder 211 are connected to the output terminals of the Y address buffer 210, and the output terminals of the Y address decoder 211 are connected to an edge of each row selection line 11 (an edge at the right side in FIG. 1). The Y address decoder 211 decodes the Y address signals, Ay0 to Ayi, which are output from the Y address buffer 210 and alternatively outputs an H-level Y selection signal to one row selection line 11 from among the connected row selection lines 11. Accordingly, the row selection line 11 in accordance with the Y address signals, Ay0 to Ayi, is alternatively selected.

In contrast, X address signals, Ax0 to Axj, are supplied from the high-level device (not shown) to the X address buffer 220. The X address buffer 220 is activated when the H level enable signal is supplied from the operation control circuit 20, and outputs the X address signals, Ax0 to Axj, which are supplied thereto at that moment to the X address decoder 221. The input terminals of the X address decoder 221 are connected to the output terminals of the X address buffer 220, and the output terminals of the X address decoder 221 are connected to the input terminals of the sampling/holding circuit 222. The X address decoder 221 decodes the X address signals, Ax0 to Axj, output from the X address buffer 220 and generates an X selection signal. The X selection signal is a signal that alternatively selects a column selection line 12 from among the column selection lines 12 in accordance with the X address signals Ax0 to Axj.

The sampling/holding circuit 222 outputs the gray-scale data D0, D1, and D2, which are supplied from the input circuit 240, to the column selection line 12 specified by the X selection signal output from the X address decoder 221.

With this arrangement, in the write mode, the gray-scale data D0, D1, and D2, output from the input circuit 240, are supplied to the pixel 13 corresponding to an intersection of the row selection line 11, to which the Y selection signal generated by the Y address decoder 221 is output, and the column selection line 12 specified by the X selection signal generated by the X address decoder 221.

In this embodiment, a voltage that turns on the pixel 13 or a voltage that turns off the pixel 13, is applied to the pixel 13 with a time density in accordance with the gray-scale data D0 to D2 and gray-scale signals P0 to P2 (details are described hereinafter). The gray-scale signal generating circuit 23 is a circuit that generates and outputs the gray-scale signals P0, P1, and P2. The gray-scale signals P0, P1, and P2 are at the H level for a predetermined period of time in each field. Details are described as follows.

In this embodiment, one field (1*f*) is divided into three sub-fields Sf1 to Sf3. In units of sub-fields, the pixels 13 are turned on or off, thereby performing 8-level gray-scale display. The specific time period in each sub-field will now be described (see FIG. 6(*a*)).

The sub-field Sf1 is set as follows. By applying the voltage VH to the liquid crystal layer in the sub-field Sf1 in one field (1*f*), the effective voltage value applied to the liquid crystal layer in that field (1*f*) becomes voltage V4, (see FIG. 4) in accordance with a transmissivity of 57.1% corresponding to a gray-level of $2^2$ (=4). Specifically, the effective voltage value can be obtained by finding the root mean square of the instantaneous voltage values over one period (1 field (1*f*)). Thus, the sub-field Sf1 is set at a time period of $(V4/VH)^2$ with respect to one field (1*f*).

The sub-field Sf2 is set as follows. By applying the voltage VH to the liquid crystal layer in the sub-field Sf2 in one field (1*f*), the effective voltage value applied to the liquid crystal layer in that field (1*f*) becomes V1, (see FIG. 4) in accordance with a transmissivity of 14.3% corresponding to a gray-level of $2^0$ (=1). Similarly, the sub-field Sf3 is set as follows. By applying the voltage VH to the liquid crystal layer in the sub-field Sf3 in one field (1*f*), the effective voltage value applied to the liquid crystal layer in that field (1*f*) becomes voltage V2, in accordance with a transmissivity of 28.6% corresponding to a gray-level of $2^1$ (=2).

The specific time periods of the sub-fields have been described above. In this embodiment, the time period of each sub-field is set at a time period in which an effective voltage, which implements gray-scale display at $2^0$, $2^1$, or $2^2$ level, is applied to the liquid crystal layer of the pixel.

In this embodiment, a case has been described in which 8-level gray-scale display in accordance with 3-bit gray-scale data is performed. However, it is understood that the present invention is not limited to this case. For example, when performing $2^k$-level gray-scale display in accordance with k-bit gray-scale data (where k is a natural number such as 1, 2, 3, . . . ), k sub-fields are provided, and time periods of the sub-fields should be set at time periods in which effective voltages for displaying $2^0$, $2^1$, $2^2$, . . . , $2^{k-1}$ levels are applied to the liquid crystal layer of the pixel.

Figure 6:
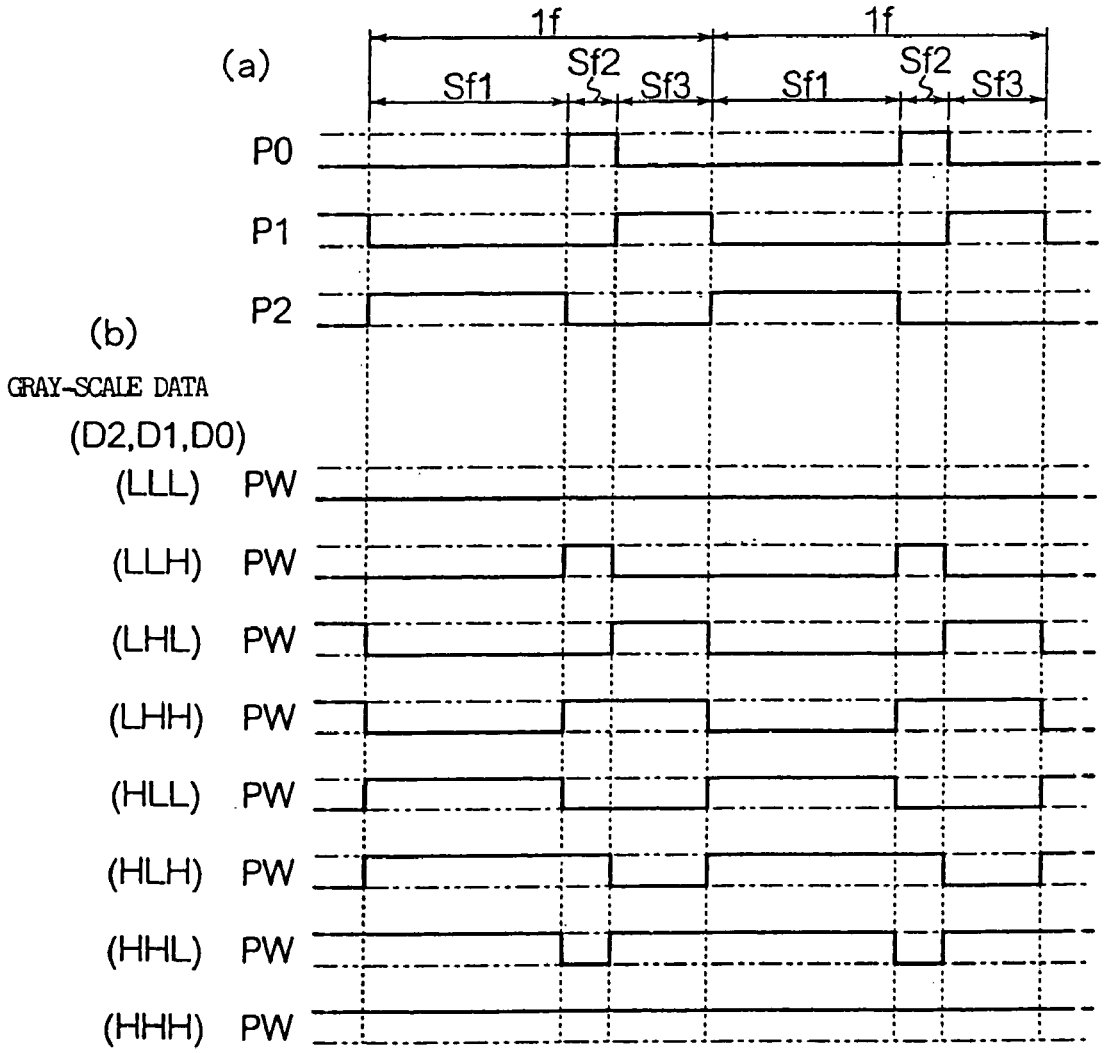
FIG. 6(*a*) is a timing chart showing waveforms of gray-scale signals in the electro-optical device, and FIG. 6(*b*) is a timing chart showing waveforms of a pulse signal PW in the pixel in the electro-optical device.

The gray-scale signals, P0 to P2, generated by the gray-scale signal generating circuit 23, each become the H level, in any one of the sub-fields obtained by dividing one field (1*f*). Specifically, as shown in FIG. 6(*a*), the gray-scale signal P0 is a signal that becomes the H level only in the sub-field Sf2. The gray-scale signal P1 is a signal that becomes the H level only in the sub-field Sf3. The gray-scale signal P2 is a signal that becomes the H level only in the sub-field Sf1.

Figure 2:
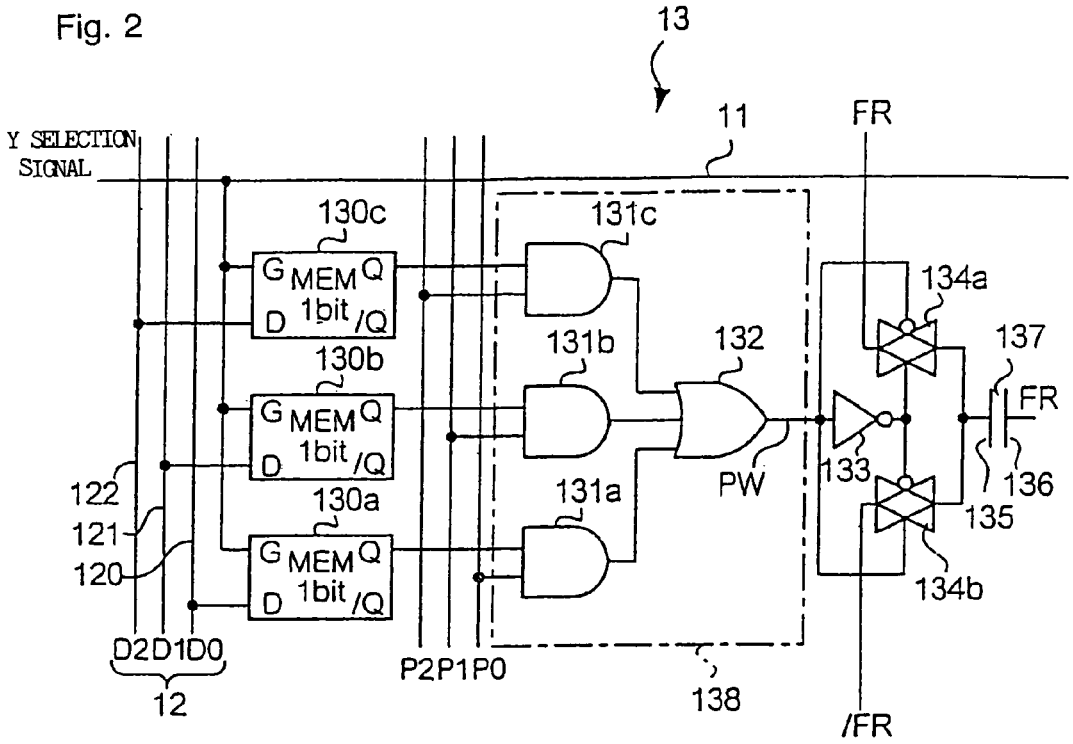
FIG. 2 is a circuit diagram of the structure of a pixel in the electro-optical device.

FIG. 2 is a circuit diagram of the specific structure of the pixel 13 of the electro-optical device according to this embodiment. As shown in the drawing, the pixel electrode of the pixel 13 includes memory cells 130*a*, 130*b*, and 130*c*, a gray-scale control circuit 138, an inverter 133, transmission gates 134*a* and 134*b*, a pixel electrode 135, a counter electrode 136, and liquid crystal 137. In the following description, when it is unnecessary to distinguish one memory cell from the memory cells 130*a*, 130*b*, and 130*c*, they are simply referred to as memory cells 130. The same applies to the reference numerals of the other parts.

In FIG. 1, in order to simplify the drawing, it is illustrated that m pixels 13 for one column are connected to one column selection line 12. More specifically, as shown in FIG. 2, each column selection line 12 consists of column selection lines 120, 121, and 122. The gray-scale data D0, D1, and D2 are supplied to the column selection lines 120, 121, and 122, respectively.

As shown in FIG. 2, the number of memory cells 130 (three in this embodiment) corresponds to the number of bits of the gray-scale data. The column selection line 120 is connected to the memory cell 130*a*, and the gray-scale data D0 is supplied to the memory cell 130*a*. The column selection line 121 is connected to the memory cell 130*b*, and the gray-scale data D1 is supplied to the memory cell 130*b*. The column selection line 122 is connected to the memory cell 130*c*, and the gray-scale data D2 is supplied to the memory cell 130*c*. The memory cells 130*a*, 130*b*, and 130*c* are connected to the row selection line 11 to which the Y selection signal is supplied.

Figure 3:
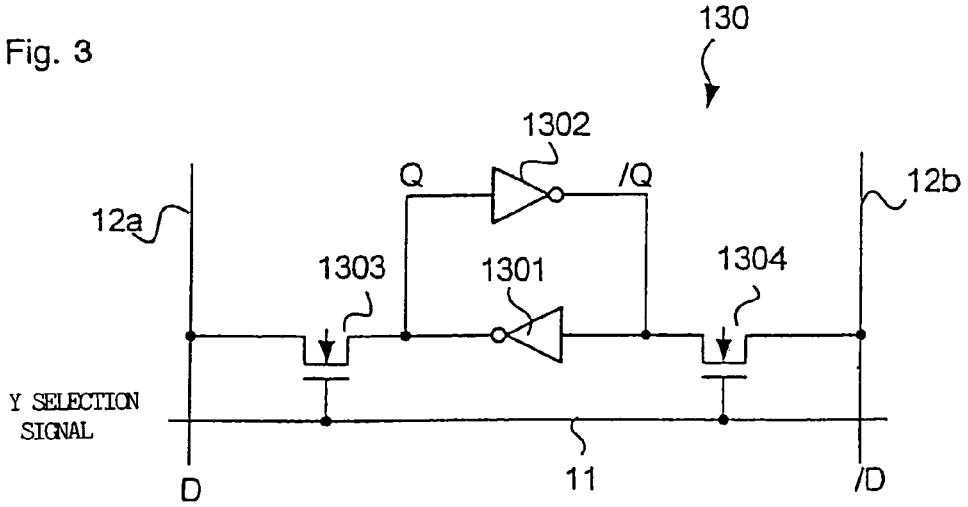
FIG. 3 is a circuit diagram of the structure of a memory cell in the electro-optical device.

FIG. 3 illustrates the specific structure of each memory cell 130. As shown in the drawing, the memory cell 130 is formed of a static memory (SRAM) consisting of inverters 1301, 1302 and transistors 1303, 1304.

As shown in FIG. 3, the inverters 1301 and 1302 form a flip-flop in which the output terminal of one inverter is connected to the input terminal of the other inverter, and form a 1-bit memory. In contrast, the transistors 1303 and 1304 are N-channel transistors that enter an on-state when the 1-bit memory is written or read. The drain of each of the transistors 1303 and 1304 is connected to each input terminal of the inverters 1302 and 1301, and the gate of each of the transistors 1303 and 1304 is connected the row selection line 11 to which the Y selection signal is supplied.

In FIG. 2, in order to simplify the drawing, it is illustrated that one of the column selection lines 120, 121, and 122 is connected to one memory cell 130. Actually, as shown in FIG. 3, each of the column selection lines 120, 121, and 122 is formed of two wires 12*a* and 12*b*. Specifically, the two column selection lines 12*a* and 12*b* are wired to one memory cell 130.

The source of the transistor 1303 is connected to the column selection line 12*a*, and the source of the transistor 1304 is connected to the column selection line 12*b*. One of the gray-scale data D0, D1, and D2 (indicated by "D" in FIG. 3) is supplied to the column selection line 12*a*. The column selection line 12*b* is supplied with data (indicated by "/D" in FIG. 3) obtained by inverting the level of the gray-scale data supplied to the column selection line 12*a*.

Each memory cell 130 has the above configuration. By outputting an H-level Y selection signal to the row selection line 11, the transistors 1303 and 1304 are turned on. In this state, when the gray-scale data and the level-inverted data are supplied to the column selection lines 12*a* and 12*b*, respectively, the gray-scale data is stored in the memory formed of the inverters 1301 and 1302. The stored data is maintained even when the Y selection signal becomes the L level and the transistors 1303 and 1304 are turned off. In the following description, the output of the inverter 1301 is referred to as Q output, and the output of the inverter 1302 is referred to as /Q output.

Referring back to FIG. 2, the Q output of each memory cell 130 in the pixel 13 and the gray-scale signals P0, P1, and P2 output from the gray-scale signal generating circuit 23 are input to the gray-scale control circuit 138. The gray-scale control circuit 138 performs arithmetic processing of the input signals, thereby generating and outputting a pulse signal PW with a time density in accordance with the gray-scale data D0 to D2 written to each memory cell 130, in one field (1*f*). Specifically, the gray-scale control circuit 138 includes AND gates 131*a*, 131*b*, and 131*c*, and the number of AND gates 131 corresponds to the number of memory cells 130. The Q output of the memory cell 130 is input to one of two input terminals of each AND gate 131. The other input terminal of each AND gate 131 is connected to wires to which the gray-scale signals P0, P1, and P2, generated by the gray-scale signal generating circuit 23, are supplied. As a result, each AND gate 131 implements an AND operation of the two input signals. The output signals from the AND gates 131*a* to 131*c* are input to an OR gate 132, and the OR gate 132 implements an OR operation of the input signals. Details are described hereinafter. With this arrangement, the pulse signal PW, with a time density in accordance with the gray-scale data, D0 to D2, is output from the gray-scale control circuit 138. In this specification, time density is the ratio (density) of a time period in which a pixel is turned on (or off) to a time period of one field.

The output terminals of the transmission gates 134*a* and 134*b* are connected to the pixel electrode 135. The liquid crystal 137 is filled between the pixel electrode 135 and the counter electrode 136, thereby forming the liquid crystal layer. The counter electrode 136 is a transparent electrode formed over the opposing substrate so that the counter electrode 136 is opposed to the pixel electrode 135 formed on the device substrate. A field reverse signal FR is supplied from a voltage generating circuit (not shown) to the counter electrode 136. The field reverse signal FR is a signal whose level is inverted for every field (1*f*), such as from VH to VL, from VL to VH, and so forth (see FIG. 7). In order to simplify the description, concerning the level of the field reverse signal FR, sometimes VH is simply referred to as the H level, and VL is simply referred to as the L level.

The pulse signal PW output from the gray-scale control circuit 138 is supplied to the gate of a P-channel transistor of the transmission gate 134*a* and to the gate of an N-channel transistor of the transmission gate 134*b*. After the level of the pulse signal PW is inverted by the inverter 133, the pulse signal PW is supplied to the gate of an N-channel transistor of the transmission gate 134*a* and to the gate of a P-channel transistor of the transmission gate 134*b*. The transmission gates 134*a* and 134*b* are the gates which are turned on by applying an L-level gate signal to the P-channel transistors and an H-level gate signal to the N-channel transistors. Thus, one of the transmission gates, 134*a* or 134*b*, is turned on and the other is turned off, in accordance with the level of the pulse signal PW. The input terminal of the transmission gate 134*a* is connected to a wire to which the above-described field reverse signal FR is supplied. In contrast, the input terminal of the transmission gate 134*b* is connected to a wire to which the signal /FR is supplied. The signal /FR is a signal obtained by inverting the level of the field reverse signal FR. In other words, when the field reverse signal FR is at the H level (=VH), the signal /FR is at the L level (=VL). When the field reverse signal FR is at the L level (=VL), the signal /FR is at the H level (=VH).

With this arrangement, when the H-level pulse signal PW is supplied from the gray-scale control circuit 138, the transmission gate 134*a* is turned off, and the transmission gate 134*b* is turned on. Thus, the signal /FR is supplied to the pixel electrode 135 through the transmission gate 134*b*. As a result, the difference voltage VH, between the voltage applied to the pixel electrode 135 and the voltage applied to the counter electrode 136, is applied to the liquid crystal layer of the pixel 13, thereby turning on the pixel 13. In contrast, when the L-level pulse signal PW is supplied from the gray-scale control circuit 138, the transmission gate 134*a* is turned on, and the transmission gate 134*b* is turned off. Thus, the field reverse signal FR is supplied to the pixel electrode 135. As a result, the voltage applied to the liquid crystal layer of the pixel 13 is VL (=0V). As a result, the pixel 13 is turned off.

In FIG. 2, an example in which the gray-scale control circuit 138 includes three AND gates and one OR gate has been descried. However, it is understood that the configuration of the gray-scale control circuit 138 is not limited to this example. In short, any circuit can be used as long as it can generate a pulse signal PW with time density in accordance with gray-scale data, D0 to D2, using the gray-scale data and a plurality of gray-scale signals whose levels are periodically inverted.

B-2: Operation of First Embodiment

The operation of the electro-optical device according to this embodiment is described.

The operation in a case in which gray-scale data is written to the memory in the pixel 13 in the write mode, in order to perform gray-scale display is described. In order to simplify the description, the operation in a case in which gray-scale data, D0 to D2, are supplied to one pixel is described.

First, when the L-level chip enable signal /CE and the L-level write enable signal /WE are supplied from the high-level device (not shown), the electro-optical device enters the write mode. Each portion of the electro-optical device performs the operation in order to write the gray-scale data to the pixel 13.

The Y address decoder 211 decodes the Y address signals, Ay0 to Ayi, received through the Y address buffer 210 and outputs the H-level Y selection signal to the row selection line 11, specified by the Y address signals, Ay0 to Ayi.

In contrast, the X address decoders 221 decodes the X address signals, Ax0 to Axj, received through the X address buffer 220, to generate and output the X selection signal.

The input circuit 240 is activated when the H-level enable signal is supplied from the operation control circuit 20. The input circuit 240 outputs the gray-scale data, D0 to D2, which are supplied from the high-level device, through the input/output terminals, I/O0 to I/O2, to the sampling/holding circuit 222. The sampling/holding circuit 222 outputs the gray-scale data, D0 to D2, which are supplied from the input circuit 240, to the column selection line 12 specified by the X selection signal from the X address decoder 221.

Then, the transistors 1303 and 1304 (see FIG. 3), which are in the memory cell 130 provided in the pixel 13 to which the data is to be written, enter an on-state in response to the H-level Y selection signal. The gray-scale data, D0 to D2, output from the sampling/holding circuit 222 are written to the memory cells 130*a*, 130*b*, and 130*c* in the pixel 13, respectively.

When the gray-scale data, D0 to D2, are written in the memory cells 130, the gray-scale control circuit 138 generates and outputs the pulse signal PW that becomes the H level or the L level in accordance with the gray-scale data, D0 to D2, and the gray-scale signals P0 to P2. In a period in which the pulse signal PW is at the H level, a voltage that turns on the pixel is applied to the liquid crystal layer of the pixel. In contrast, in a period in which the pulse signal PW is at the L level, a voltage that turns off the pixel is applied to the liquid crystal layer of the pixel.

Details are described as follows.

FIG. 5 is a truth table showing the relationship of the gray-scale data, D0 to D2, and the gray-scale signals, P0 to P2, with the pulse signal PW output from the gray-scale control circuit 138 in the pixel 13. FIG. 6(*b*) is a timing chart showing waveforms of the pulse signals PW output from the gray-scale control circuit 138 in the pixel 13 in accordance with the gray-scale data D0 to D2.

When all of the gray-scale data D0 to D2 are at the L level, as shown in FIGS. 5 and 6(*b*), the pulse signal PW is at the L level in all of the sub-fields.

When the gray-scale data is (LLH) (that is, when the gray-scale data D2 and D1 are at the L level and when the gray-scale data D0 is at the H level; hereinafter the gray-scale data will be written in this manner), as indicated by the truth table in FIG. 5, the pulse signal PW is at the H level only when the gray-scale signal P0 is at the H level. In other cases, the pulse signal PW is at the L level. Since the gray-scale signal P0 is at the H level in the sub-field Sf2 (see FIG. 6(*a*)), the pulse signal PW is at the H level only in the sub-field Sf2, as shown in FIG. 6(*b*).

When the gray-scale data is (LHL), as indicated by the truth table in FIG. 5, the pulse signal PW is at the H level only when the gray-scale signal P1 is at the H level. In other cases, the pulse signal PW is at the L level. Since the gray-scale signal P1 is at the H level in the sub-field Sf3 (see FIG. 6(*a*)), the pulse signal PW is at the H level only in the sub-25, field Sf3, as shown in FIG. 6(*b*). When the gray-scale data is (LHH), as indicated by the truth table in FIG. 5, the pulse signal PW is at the H level when one of the gray-scale signals P0 and P1 is at the H level. As shown in FIG. 6(*a*), the gray-scale signal P0 is at the H level in the sub-field Sf2, and the gray-scale signal P1 is at the H level in the sub-field Sf3. In other words, when the gray-scale data is (LHH), as shown in FIG. 6(*b*), the pulse signal PW is at the 30H level in the sub-fields Sf2 and Sf3.

The same applies to cases in which other gray-scale data are applied. Specifically, the sub-field in which the pulse signal PW is at the H level (or L level) is determined in accordance with the gray-scale data written to each memory cell 130 in the pixel 13. Accordingly, the gray-scale control circuit 138 has a function of performing arithmetic processing of the gray-scale data, D0 to D2, stored in each memory cell 130 and the gray-scale signals, P0 to P1, thereby generating the pulse signal PW with time density in accordance with the gray-scale data D0 to D2 in one field.

Figure 7:
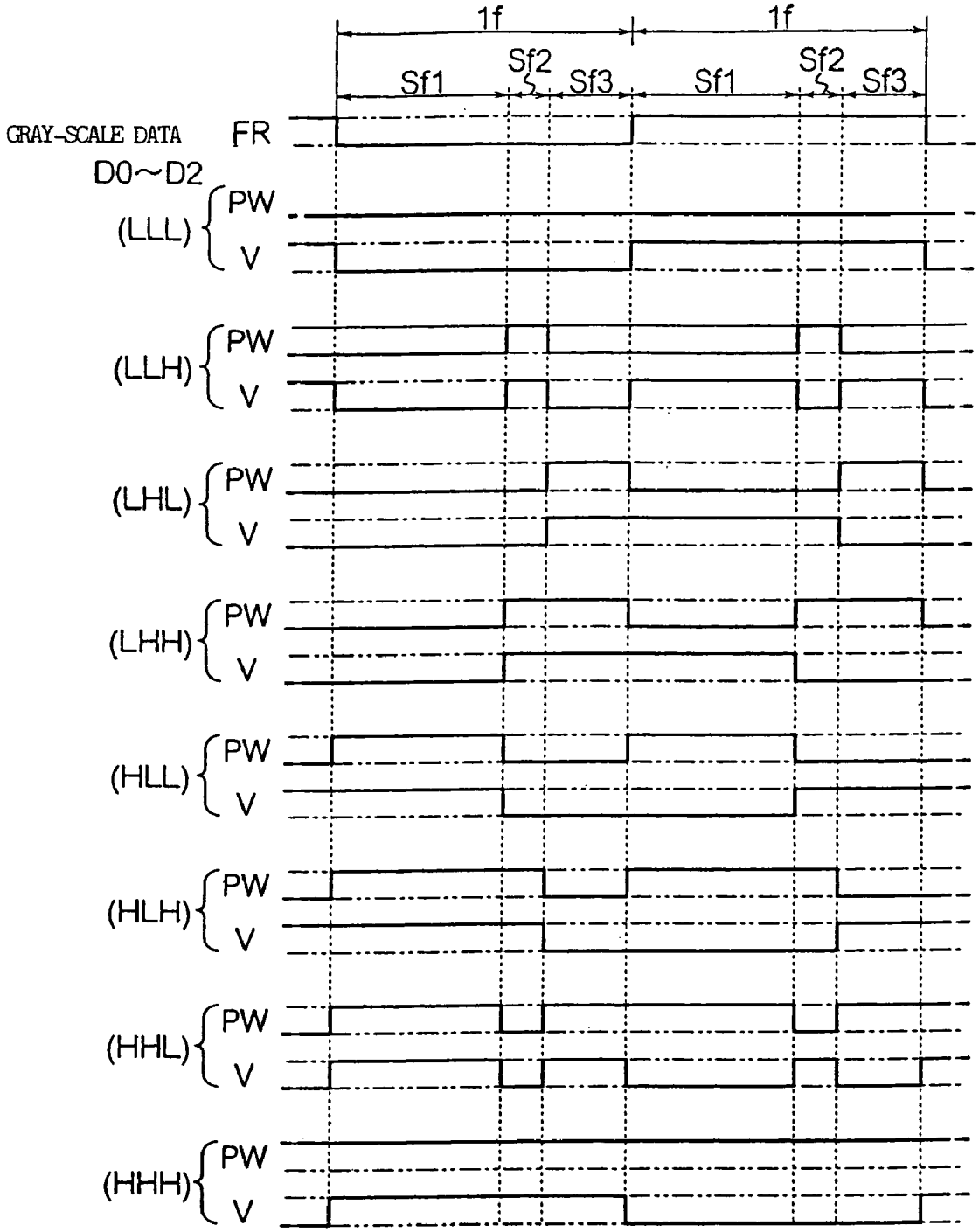
FIG. 7 is a timing chart showing a voltage applied to a pixel electrode in each pixel in the electro-optical device.

A voltage applied to the pixel electrode 135 in the pixel 13 when the gray-scale data D0 to D2 are applied is described. FIG. 7 is a timing chart showing the relationship between the gray-scale data, D0 to D2, written to each memory cell 130 in the pixel 13 and, the voltage V applied to the pixel electrode 135 in the pixel 13, in accordance with the gray-scale data D0 to D2. Note that in FIG. 7, the waveform of the pulse signal PW shown in FIG. 6(*b*) is shown above each voltage V applied to the pixel electrode 135 in accordance with the gray-scale data.

When the gray-scale data is (LLL), the pulse signal PW is at the L level in all the sub-fields. In this case, since the transmission gate 134*a* shown in FIG. 2 is in an on-state in all the sub-fields, the field reverse signal FR is applied to the pixel electrode 135 in the pixel 13. At the same time, the field reverse signal FR is applied to the counter electrode 136 which is opposed to the pixel electrode 135 with the liquid crystal 137 therebetween. Thus, the voltage applied to the liquid crystal layer of the pixel is VL (=0V) in all the sub-fields. As a result, the pixel 13 is in an off-state in all the sub-fields. In this case, the transmissivity of the liquid crystal is 0% in accordance with the gray-scale data (LLL).

When the gray-scale data is (LLH), the pulse signal PW is at the H level in the sub-field Sf2, and at the L level in the other sub-fields. In this case, the transmission gate 134*b* is in an on-state in the sub-field Sf2. Thus, the signal /FR obtained by inverting the level of the field reverse signal FR, is applied to the pixel electrode 135. On the contrary, since the transmission gate 134*a* is in an on-state in the sub-fields Sf1 and S13, the field reverse signal FR, is applied to the pixel electrode 135. Thus, the voltage VH is applied to the liquid crystal layer of the pixel 13 in the sub-field Sf2, thereby turning on the pixel 13. The voltage VL (=0V) is applied to the liquid crystal layer in the sub-fields Sf1 and Sf3, thereby turning off the pixel 13. As a result, the effective voltage value applied to the liquid crystal layer of the pixel 13 in one field is V1, as shown in FIG. 4. The transmissivity of the pixel 13 is 14.3% in accordance with the gray-scale data (LLH).

When the gray-scale data is (LHH), the pulse signal PW is at the H level in the sub-fields Sf2 and Sf3, and at the L level in the sub-field Sf1. Thus, the voltage VH is applied to the liquid crystal layer of the pixel 13 in the sub-fields Sf2 and Sf3, thereby turning on the pixel 13. Since the voltage applied to the liquid crystal layer of the pixel 13 in the sub-field Sf1 is VL (=0V), the pixel 13 is in an off-state. As a result, the effective voltage value applied to the liquid crystal layer of the pixel 13 in one field is V3, as shown in FIG. 4. The transmissivity of the pixel 13 is 42.9% in accordance with the gray-scale data (LHH).

The same applies to cases in which other gray-scale data are applied. In other words, the signal /FR which has the inverted level to that of the field reverse signal FR is applied to the pixel electrode 135 in a sub-field in which the pulse signal PW is at the H level. As a result, the pixel 13 is in an on-state.

On the other hand, in a sub-field in which the pulse signal PW is at the L level, the field reverse signal FR is applied to the pixel electrode 135, thereby tuning off the pixel 13. As a result, the effective voltage in accordance with the gray-scale data is applied to the liquid crystal layer of the pixel 13 in one field, thereby achieving the transmissivity in accordance with the gray-scale data. In other words, the voltage that turns on/off the pixel 13 is applied to the liquid crystal layer in the pixel 13 with time density in accordance with the gray-scale data stored in each memory cell 130. Thus, in this embodiment, the gray-scale control circuit 138 shown in FIG. 2 corresponds to the "pulse duration control circuit" set forth in the claims. The transmission gates 134*a* and 134*b* which are turned on/off by the pulse signal PW, which is the output signal from the gray-scale control circuit 138, correspond to the "switching circuit" set forth in the claims. A set of the gray-scale control circuit 138 and the transmission gates 134*a* and 134*b* corresponds to the "pixel driving circuit" set forth in the claims. The pixel driving circuit is not limited to that illustrated in this embodiment. Any circuit can be used as long as it generates a pulse signal with time density in accordance with gray-scale data and applies a voltage that turns on/off each pixel in accordance with the pulse signal to the pixel.

As described above, the field reverse signal FR is a signal whose level is inverted every field. Therefore, as shown in FIG. 7, a voltage applied to the liquid crystal layer of the pixel 13 in a particular field and a voltage applied to the liquid crystal layer of the pixel 13 in a field prior to or subsequent to that particular field have opposite polarities. In other words, since the polarity of the voltage applied to the liquid crystal layer is periodically inverted, application of a direct current (DC) component to the liquid crystal can be prevented. As a result, deterioration of the liquid crystal can be prevented.

According to this embodiment, one field is divided into a plurality of sub-fields. In units of sub-fields, the voltage VH that turns on each pixel 13 or the voltage VL (=0V) that turns off each pixel 13 is applied to the liquid crystal layer of each pixel 13, thereby controlling the effective voltage value in one field. In other words, driving circuits can be formed using circuits that deal with digital values. Thus, peripheral circuits such as driving circuits do not require circuits such as a high-accuracy D/A converter circuit and an operational amplifier for processing analog signals. As a result, the circuit configuration is greatly simplified, and the cost of the overall device is reduced. In addition t this, since the voltage applied to the liquid crystal has two levels, display unevenness due to nonuniformity in device characteristics and wiring resistances does not occur in theory. According to the electro-optical device of this embodiment, high-quality and high-definition gray-scale display can be performed.

According to this embodiment, since the pixel 13 is turned on/off with a time density in accordance with the gray-scale data, D0 to D2, stored in each memory cell 130, when there is no change in the gray-scale data in the pixel 13, it is unnecessary to rewrite the gray-scale data. In other words, gray-scale display can be implemented by writing the gray-scale data only to the pixel 13 when the gray-scale data is changed. Compared with a case in which the gray-scale data is written to all of the pixels every field, for example, the power consumption can be reduced significantly. In particular, when displaying still images or moving images in which there are not many changes in the images, the number of times the gray-scale data is written to the pixels is significantly reduced. As a result, the foregoing advantage becomes more noticeable.

According to this embodiment, the operation in a write mode has been described. With the configuration shown in FIG. 1, it is possible to read the gray-scale data written in a memory in the pixel 13 in a read mode. Specifically, when the L-level chip enable signal /CE, the L-level output enable signal /OE, and the H-level write enable signal /WE are supplied from the high-level device (not shown), the H-level enable signal is supplied to the Y address buffer 210, the X address buffer 220, and the output circuit 241. The gray-scale data is read from a memory in the pixel specified by the Y address signals, Ay0 to Ayi, and the X address signals, Ax0 to Axj, and is output to the high-level device through the input/output terminals I/O0 to I/O2. With this arrangement, the high-level device is not required to have a memory for storing the gray-scale data for each pixel.

C: Second Embodiment

An electro-optical device according to a second embodiment of the present invention will now be described. The electro-optical device of the second embodiment has the same structure as that of the electro-optical device of the first embodiment except for the gray-scale signals, P0 to P2, and the pixel structure. In the following description, therefore, only parts which differ from the first embodiment are described.

In the second embodiment, one field is divided into seven sub-fields. In units of sub-fields, each pixel is turned on/off, thereby implementing 8-level gray-scale display in accordance with 3-bit gray-scale data D0 to D2. Application of a voltage to each pixel and time-periods of sub-fields, Sf1 to Sf7, are specifically described as follows.

For example, when gray-scale data (LLH) is applied to a particular pixel, that is, when performing gray-scale display in which the pixel has a transmissivity of 14.3%, the voltage VH is applied to the liquid crystal layer of the pixel in the sub-field Sf1 in one field (1*f*), while in the other sub-fields, Sf2 to Sf7, the voltage VL (=0V) is applied to the liquid crystal layer. Since the effective voltage value can be obtained by finding the root mean square of the instantaneous voltage value over one period (1 field), the sub-field Sf1 is set to a period of $(V1/NH)^2$ with respect to one field (1*f*). With this voltage application, the effective voltage value applied to the liquid crystal layer in one field (1*f*) is V1.

For example, when gray-scale data (LHL) is applied to a particular pixel, that is, when performing gray-scale display in which the pixel has a transmissivity of 28.6%, the voltage VH is applied to the liquid crystal layer in the sub-fields Sf1 and Sf2 in one field (1*f*), while in the other sub-fields, Sf3 to Sf7, the voltage VL is applied to the liquid crystal layer. By setting the sub-fields Sf1 and Sf2 to a period of $(V2/VH)^2$ with respect to one field, with this voltage application, the effective voltage value applied to the liquid crystal layer in one field (1*f*) is V2. As described above, the sub-field Sf1 is set to a period of $(V1/VH)^2$. Thus, the sub-field S2 can be set to a period of $(V2/VH)^2-(V1/VH)^2$.

Similarly, when gray-scale data (LHH) is applied to a particular pixel, that is, when performing gray-scale display in which the pixel has a transmissivity of 42.9%, the voltage VH is applied to the liquid crystal layer in the sub-fields, Sf1 to Sf3, in one field (1*f*). In the other sub-fields, Sf4 to Sf7, the voltage VL is applied to the liquid crystal layer. By setting the sub-fields, Sf1 to Sf3, to a period of $(V3/VH)^2$ with respect to one field (1*f*), with this voltage application, the effective voltage value applied to the liquid crystal layer is V3. As described above, the sub-fields, Sf1 and Sf2, are set to a period of $(V2/VH)^2$. Thus, the sub-field Sf3 can be set to a period of $(V3/VH)^2-(V2/VH)^2$.

In the same way, a time period of each of the sub-fields Sf4 to Sf6 is determined. Finally, the sub-field Sf7 is set to a period obtained by subtracting the sub-fields, Sf1 to Sf6, from one field (1*f*). As described above, however, it is necessary to ensure that the sum of time periods of the sub-fields, Sf1 to Sf7, is greater than or equal to $(V7/VH)^2$ with respect to one field (1*f*). It is noted that even when the sum of time periods of the sub-fields, Sf1 to Sf7, is longer than a time period of $(V7/VH)^2$ with respect to one field (1*f*), that is, when the voltage effective value applied to the liquid crystal layer exceeds V7 in FIG. 4, the transmissivity is 100% due to saturation.

In the second embodiment, the voltage applied to the liquid crystal layer in one field differs from that in the first embodiment. Thus, the gray-scale signals, P0, P1, and P2, output from the gray-scale signal generating circuit 23 differ from those in the first embodiment.

Figure 10:
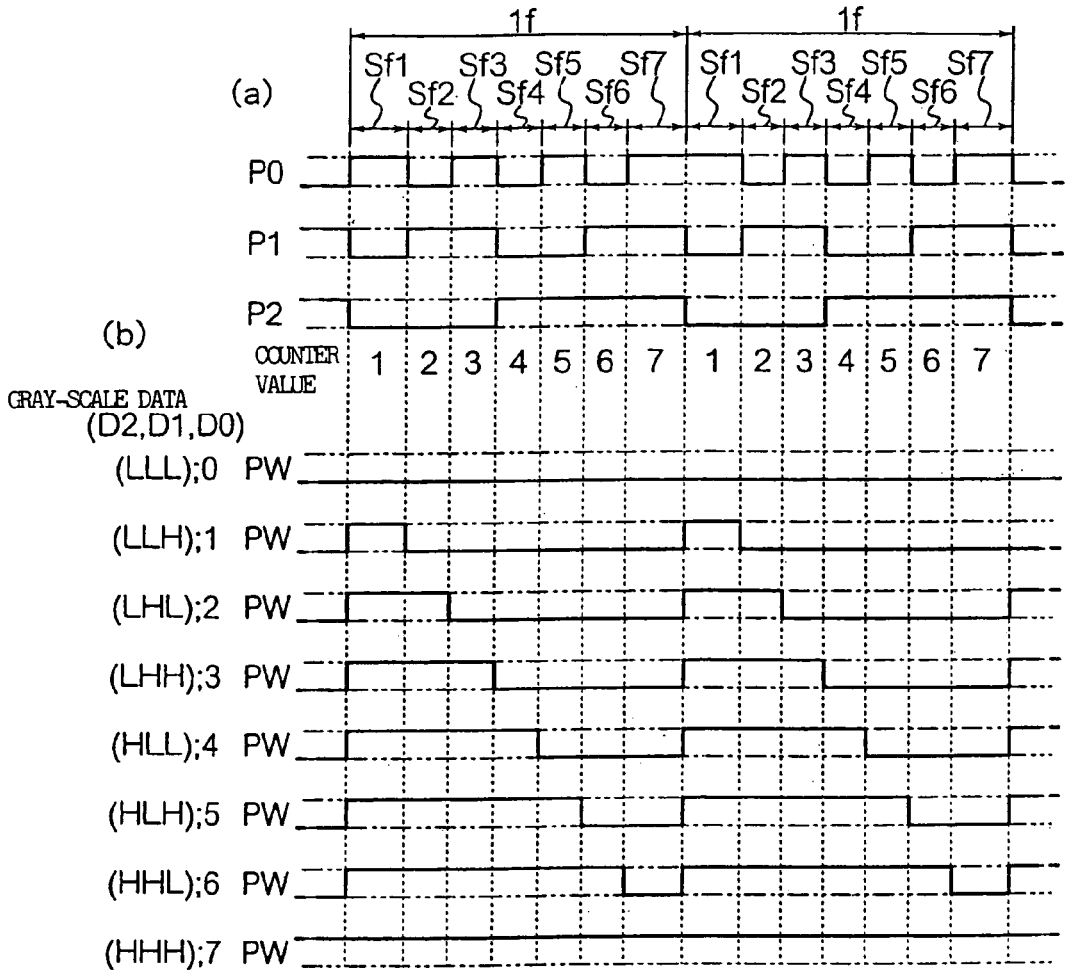
FIG. 10(*a*) is a timing chart showing waveforms of gray-scale signals in the electro-optical device, and FIG. 10(*b*) is a timing chart showing waveforms of a pulse signal PW in the pixel in the electro-optical device.

FIG. 10(*a*) is a timing chart showing waveforms of the gray-scale signals, P0 to P2, in the second embodiment. As shown in the drawing, each gray-scale signal is set so that it is at the H level or the L level in units of sub-fields within one field. In the second embodiment, as shown in FIG. 10(*a*), output signals from a 3-bit counter that counts from "1" to "7" are used as the gray-scale signals P0 to P2. Specifically, in the sub-field Sf1, the gray-scale signals P0, P1, and P2 are at the H level, L level, and L level, respectively, thereby indicating a counter value of "1". In the sub-field Sf2, the gray-scale signals P0, P1, and P2 are at the L level, H level, and L level, respectively, thereby indicating a counter value of "2". In the sub-field Sf3, the gray-scale signals P0, P1, and P2 are at the H level, H level, and L level, respectively, thereby indicating a counter value of "3".

Figure 8:
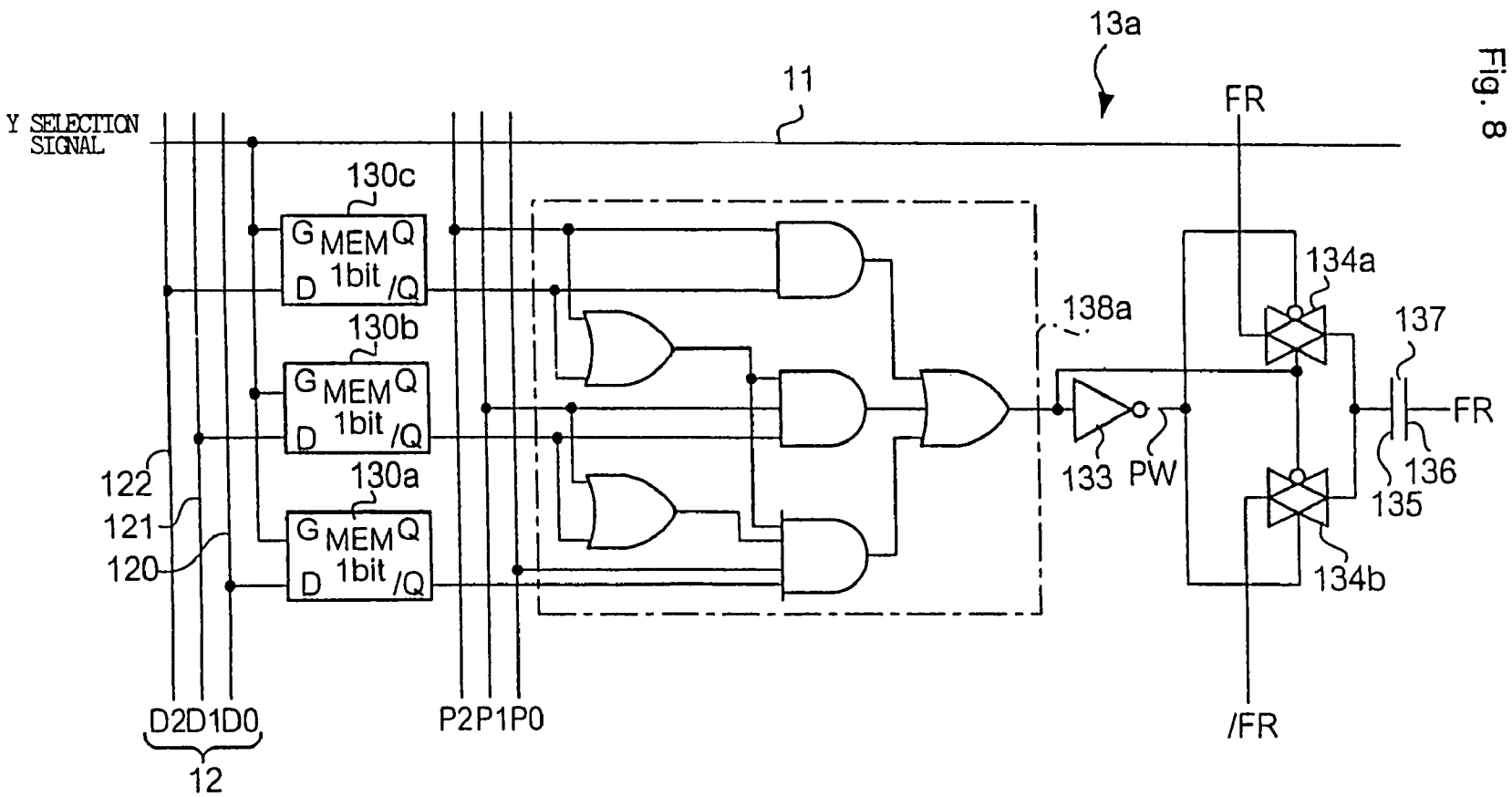
FIG. 8 is a circuit diagram of the structure of a pixel in an electro-optical device according to a second embodiment of the present invention.

FIG. 8 is a circuit diagram of the specific structure of a pixel 13*a* in the electro-optical device of the second embodiment. Each memory cell 130 shown in FIG. 8 is similar to that of the first embodiment as shown in FIG. 3 except that the former has a structure in which the output (/Q output) of the inverter 1302 in the memory cell 130 is supplied to a gray-scale control circuit 138*a* at the subsequent stage.

As shown in FIG. 8, the gray-scale control circuit 138*a* is a comparator circuit that includes an OR gate to which the /Q output from the memory cell 130*b* and the gray-scale signal P1 are input, an OR gate to which the /Q output from the memory cell 130*c* and the gray-scale signal P2 are input, three AND gates, and an OR gate at the final output. Furthermore, the inverter 133 to which an output signal from the gray-scale control circuit 138*a* is input as an input signal is provided. In the following description, an output signal from the inverter 133 shown in FIG. 8 is referred to as a pulse signal PW.

With this arrangement, the gray-scale signals, P0 to P2, supplied from the gray-scale signal generating circuit 23 are compared with the gray-scale data, D0 to D2, written to each memory cell 130. When the counter value indicated by the gray-scale signals, P0 to P2, is less than or equal to the value indicated by the gray-scale data, D0 to D2, an H-level pulse signal PW is output. When the counter value indicated by the gray-scale signals, P0 to P2, exceeds the value indicated by the gray-scale data, D0 to D2, an L-level pulse signal PW is output. As a result, the pulse signal PW, with time density in accordance with the gray-scale data, D0 to D2, is obtained. It is understood that the gray-scale control circuit 138*a* and the inverter 133 can have any structure as long as they can output the pulse signal PW with time density in accordance with the gray-scale data, D0 to D2, and the structure is not limited to that shown in FIG. 8.

With reference to a truth table shown in FIG. 9 and a timing chart shown in FIG. 10(*b*), the relationship of the pulse signal PW with the gray-scale data, D0 to D2, and the gray-scale signals, P0 to P2, is described.

As shown in FIGS. 9 and 10(*b*), when gray-scale data (LLL) is written to each memory cell 130 in the pixel 13*a*, the pulse signal PW is at the L level in all of the sub-fields. In other words, the value that corresponds to the gray-scale data is "0". On the other hand, as shown in FIG. 10(*a*), the comparison object, that is, the counter value indicated by the gray-scale signals, is never less than or equal to "0". As a result, as shown in FIGS. 9 and 10(*b*), the pulse signal PW is at the L level in all the sub-fields.

When gray-scale data (LLH) is written to each memory cell 130 in the pixel 13*a*, and when the counter value indicated by the gray-scale signals is less than or equal to the value "1" that corresponds to the gray-scale data (LLH), the pulse signal PW is at the H level. When the counter value exceeds the value "1", the pulse signal PW is at the L level. As shown in FIG. 10(*a*), the counter value indicated by the gray-scale signals is less than or equal to "1" only in the sub-field Sf1. Accordingly, as shown in FIGS. 9 and 10(*b*), the pulse signal PW is at the H level only in the sub-field Sf1. In the other sub-fields, Sf2 to Sf7, (that is, in sub-fields in which the counter value indicated by the gray-scale signals exceeds the value "1"), the pulse signal PW is at the L level.

Next, it is assumed that gray-scale data (LHL) that corresponds to the value "2" is written to each memory cell 130. As shown in FIG. 10(*a*), the counter value indicated by the gray-scale signals is less than or equal to the value "2" only in the sub-fields Sf1 and Sf2. Accordingly, as shown in FIGS. 9 and 10(*b*), the pulse signal PW is at the H level in the sub-fields Sf1 and Sf2. In the other sub-fields, Sf3 to Sf7 (that is, in sub-fields in which the counter value indicated by the gray-scale signals exceeds the value "2" indicated by the gray-scale data), the pulse signal PW is at the L level. The same applies to cases in which other gray-scale data is applied. In the second embodiment, the value indicated by the applied gray-scale data is compared with the counter value indicated by the gray-scale signals, and the level of the pulse signal PW is set in accordance with the comparison result. In other words, sub-fields in which the pulse signal PW is at the H level and sub-fields in which the pulse signal PW is at the L level are determined in accordance with the comparison result.

Figure 11:
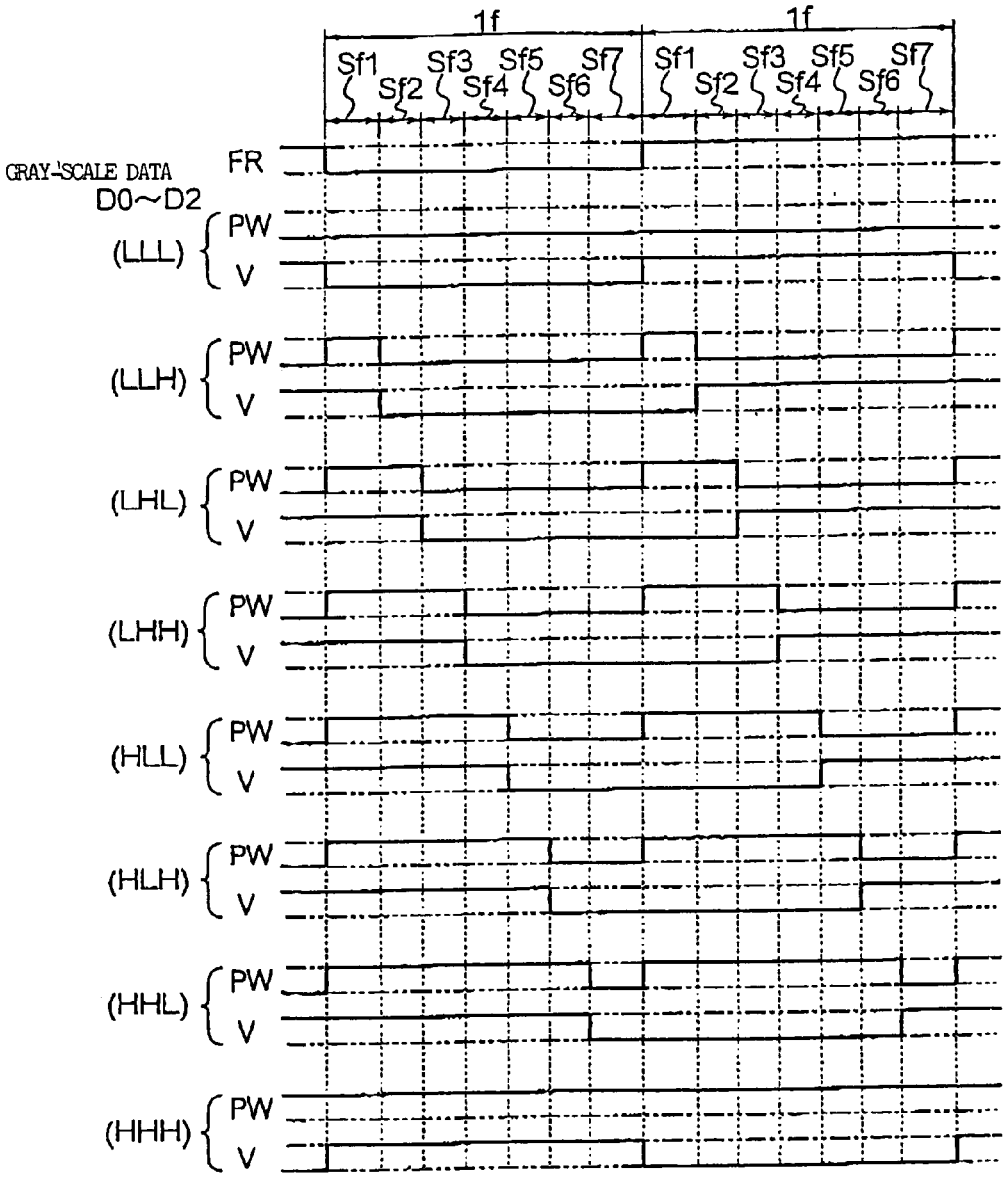
FIG. 11 is a timing chart showing a voltage applied to a pixel electrode in each pixel in the electro-optical apparatus.

Referring to FIG. 11, the voltage V, which is applied to the pixel electrode 135 in the pixel 13*a* by outputting the pulse signal PW having the above-described waveform, is described. In FIG. 11, as in FIG. 7, the pulse signal PW (shown in FIG. 10(*b*)) in accordance with gray-scale data is shown above each voltage V applied to the pixel electrode 135 in accordance with the gray-scale data.

When gray-scale data is (LLL), the pulse signal PW is at the L level in all the sub-fields. Thus, the field reverse signal FR is applied to the pixel electrode 135 in the pixel 13*a* in all the sub-fields. As a result, the pixel 13*a* is in an off-state in all the sub-fields. Thus, the transmissivity is 0% in accordance with the gray-scale data (LLL).

When gray-scale data is (LLH), the pulse signal PW is at the H level in the sub-field Sf1. In the other sub-fields, Sf2 to Sf7, the pulse signal PW is at the L level. Thus, in the sub-field Sf1, the signal /FR obtained by inverting the level of the field reverse signal FR is applied to the pixel electrode 135 in the pixel 13*a*, thereby turning on the pixel 13*a*. In the sub-fields, Sf2 to Sf7, the field reverse signal FR is applied to the pixel electrode 135 in the pixel 13*a*, thereby turning off the pixel 13*a*. Since the sub-field, Sf1 is set to a time period of $(V1/VH)^2$ with respect to one field (1 f), the effective voltage value applied to the liquid crystal layer in the pixel 13*a* in one field is V1, as shown in FIG. 4. Thus, the transmissivity of the pixel 13*a* is 14.3% in accordance with the gray-scale data (LLH).

When gray-scale data is (LHL), the pulse signal PW is at the H level in the sub-fields Sf1 and Sf2, while in the other sub-fields, Sf3 to Sf7, the pulse signal PW is at the L level. In the sub-fields Sf1 and Sf2, the voltage VH is applied to the liquid crystal layer in the pixel 13*a*, and hence the pixel 13*a* is in an on-state. In the sub-fields, Sf3 to Sf7, the voltage VL (=0V) is applied to the liquid crystal layer of the pixel 13*a*, and hence the pixel 13*a* is in an off-state. Since the sub-fields Sf1 and Sf2 are set to a time period of $(V2/VH)^2$ with respect to one field (1 f), the effective voltage value applied to the liquid crystal layer in the pixel 13*a* in one field is V2 as shown in FIG. 4. Thus, the transmissivity of the pixel 13*a* is 28.6% in accordance with the gray-scale data (LHL).

The same applies to cases in which other gray-scale data is applied. Specifically, in sub-fields in which the pulse signal PW is at the H level, the signal /FR is applied to the pixel electrode 135, thereby turning on the pixel 13*a*. In sub-fields in which the pulse signal PW is at the L level, the field reverse signal FR is applied to the pixel electrode 135, thereby turning off the pixel 13*a*. As a result, the effective voltage in accordance with the gray-scale data is applied to the liquid crystal layer in the pixel 13*a*, and hence the transmissivity in accordance with the gray-scale data is obtained.

According to the second embodiment, in addition to advantages similar to those of the first embodiment, the following advantages can be obtained.

Although the first embodiment is advantageous in that the configuration is simple, because of a predetermined weight given to the time period of each sub-field, the effective voltage (or increment thereof) that can be applied to the liquid crystal layer is determined in accordance with a manner in which the weight is determined. As there are various types of liquid crystal which have different voltage/transmissivity characteristics, it may be impossible to apply an effective voltage in accordance with desired transmissivity to the liquid crystal layer, depending on the type of liquid crystal to be used. In other words, when the method according to the first embodiment is performed, there is a problem in that it is difficult to flexibly work with various types of liquid crystal having different voltage/transmissivity characteristics.

On the other hand, according to the second embodiment, it is possible to arbitrarily set the time period of each sub-field in accordance with a voltage/transmissivity characteristic of the liquid crystal to be used. In other words, it is possible to arbitrarily set the time period of each sub-field in accordance with the voltage/transmissivity characteristic of the liquid crystal to be used so that an effective voltage in accordance with desired transmissivity can be applied to the liquid crystal layer. Accordingly, the second embodiment is advantageous to the method of the first embodiment in that it is possible to flexibly work with various types of liquid crystal having different voltage/transmissivity characteristics.

In the second embodiment, by changing the period in which the level of each gray-scale signal generated by the gray-scale signal generating circuit 23 is inverted, the time period of each sub-field can be changed. As a result, the second embodiment is advantageous in that the time period of each sub-field is easily adjusted in accordance with the voltage/transmissivity characteristic of the liquid crystal to be used.

D: Third Embodiment

An electro-optical device according to a third embodiment of the present invention is now described.

The electro-optical device of the third embodiment has the same structure as that of the foregoing embodiments except for the gray-scale signals and the pixel structure. Accordingly, descriptions of the common portions with those of the foregoing embodiments are omitted.

According to the third embodiment, one field is divided into eight sub-fields Sf0 to Sf7. In units of sub-fields, a pixel 13*b* is turned on/off, thereby performing 8-level gray-scale display. From among the eight sub-fields, Sf0 to Sf7, obtained by dividing one field, the pixel 13*b* is in an off-state in the first sub-field Sf0 regardless of the gray-scale data.

The sub-field Sf0 is required to be set to a period of $1-(V7/VH)^2$ with respect to one field (1*f*). Thus, the sub-field Sf7 is set to a period of $(V7/VH)^2-(V6/VH)^2$ with respect to one field (1*f*) (details are described hereinafter).

In the other sub-fields, Sf1 to Sf6, the pixel 13*b* is turned on or turned off, as in the second embodiment.

In the sub-fields, Sf1 to Sf7, the gray-scale signals, P0 to P2, used in the third embodiment are the same as those in the second embodiment. In the sub-field Sf0, as shown in FIG. 14(*a*), all the gray-scale signals, P0, P1, and P2, are at the L level.

Figure 12:
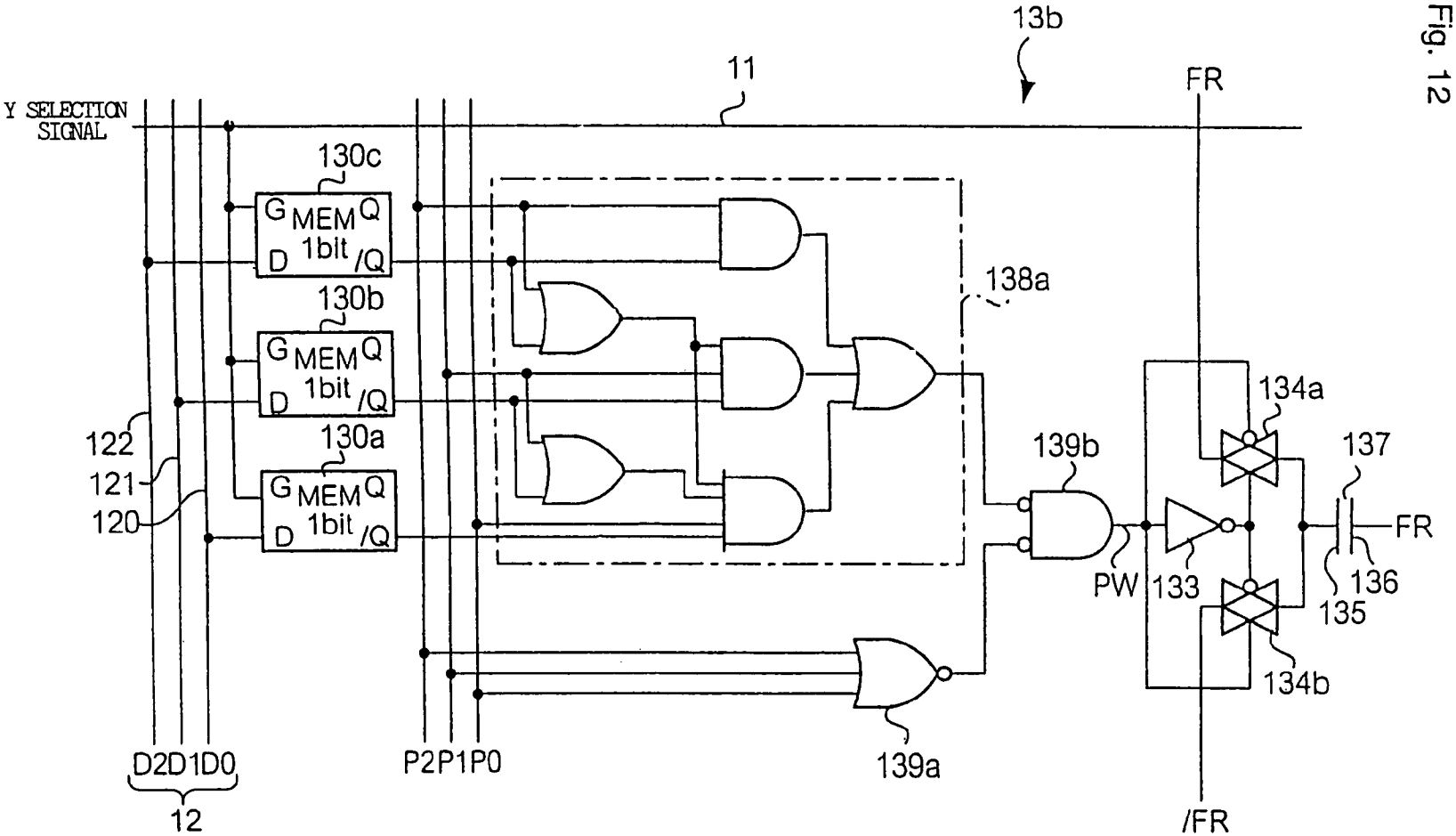
FIG. 12 is a circuit diagram of the structure of a pixel in an electro-optical device according to a third embodiment of the present invention.

FIG. 12 is a circuit diagram of the specific structure of the pixel 13*b* in the electro-optical device of the third embodiment. As shown in the drawing, the structure of the pixel 13*b* of the third embodiment is similar to that of the pixel 13*a* in the second embodiment, as shown in FIG. 8, except for a portion of the structure. Specifically, the pixel 13*b* of the third embodiment includes, besides parts included in the pixel 13*a* of the second embodiment, an NOR gate 139*a*, to which the gray-scale signals P0, P1, and P2 are supplied as input signals and an NOR gate 139*b* to which an output signal from the NOR gate 139*a* and an output signal from the gray-scale control circuit 138*a* are supplied as input signals. Note that in the following description, an output signal from the NOR gate 139*b* is referred to as a pulse signal PW.

Figures 13, 14:
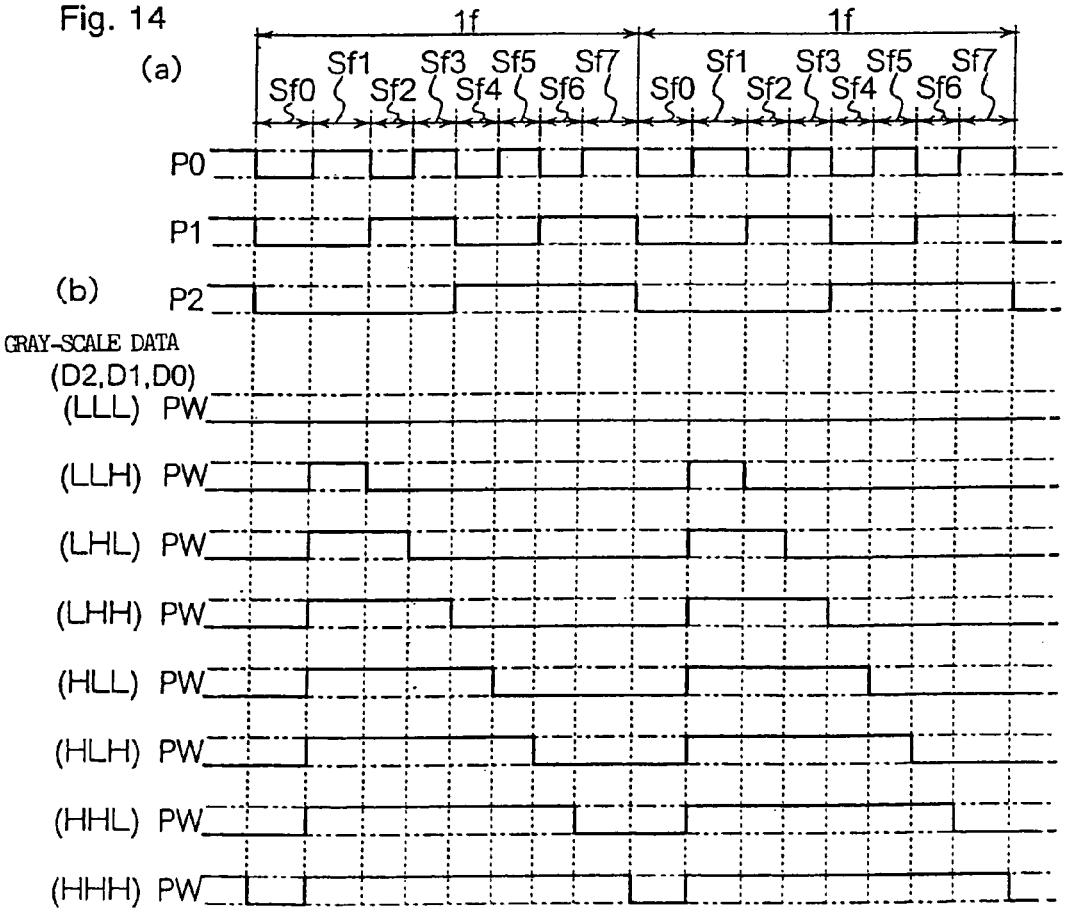
FIG. 13 is a truth table showing the operation of the pixel in the electro-optical device.
FIG. 14(*a*) is a timing chart showing waveforms of gray-scale signals in the electro-optical device, and FIG. 14(*b*) is a timing chart showing waveforms a pulse signal PW in the pixel in the electro-optical device.

FIG. 13 is a truth table showing the relationship of the gray-scale data D0 to D2 and the gray-scale signals P0 to P2 with the pulse signal PW output from the NOR gate 139*b* in the pixel 13*b*. FIG. 14(*b*) is a timing chart showing the waveform of the pulse signal PW, in accordance with the gray-scale data D0 to D2. As described above, the gray-scale signals, P0 to P2, are at the L level in the sub-field Sf0. In this case, an H-level signal is output from the NOR gate 139*a* in the pixel 13*b* shown in FIG. 12, and this signal is input to the NOR gate 139*b*. As a result, as shown in FIGS. 13 and 14(*b*), the pulse signal PW is at the L level regardless of the gray-scale data. As shown in FIGS. 13 and 14(*b*), the levels of the pulse signal PW in the sub-fields, Sf1 to Sf7, excluding the sub-field Sf0, are the same as those shown in FIG. 10(*b*).

Figure 15:
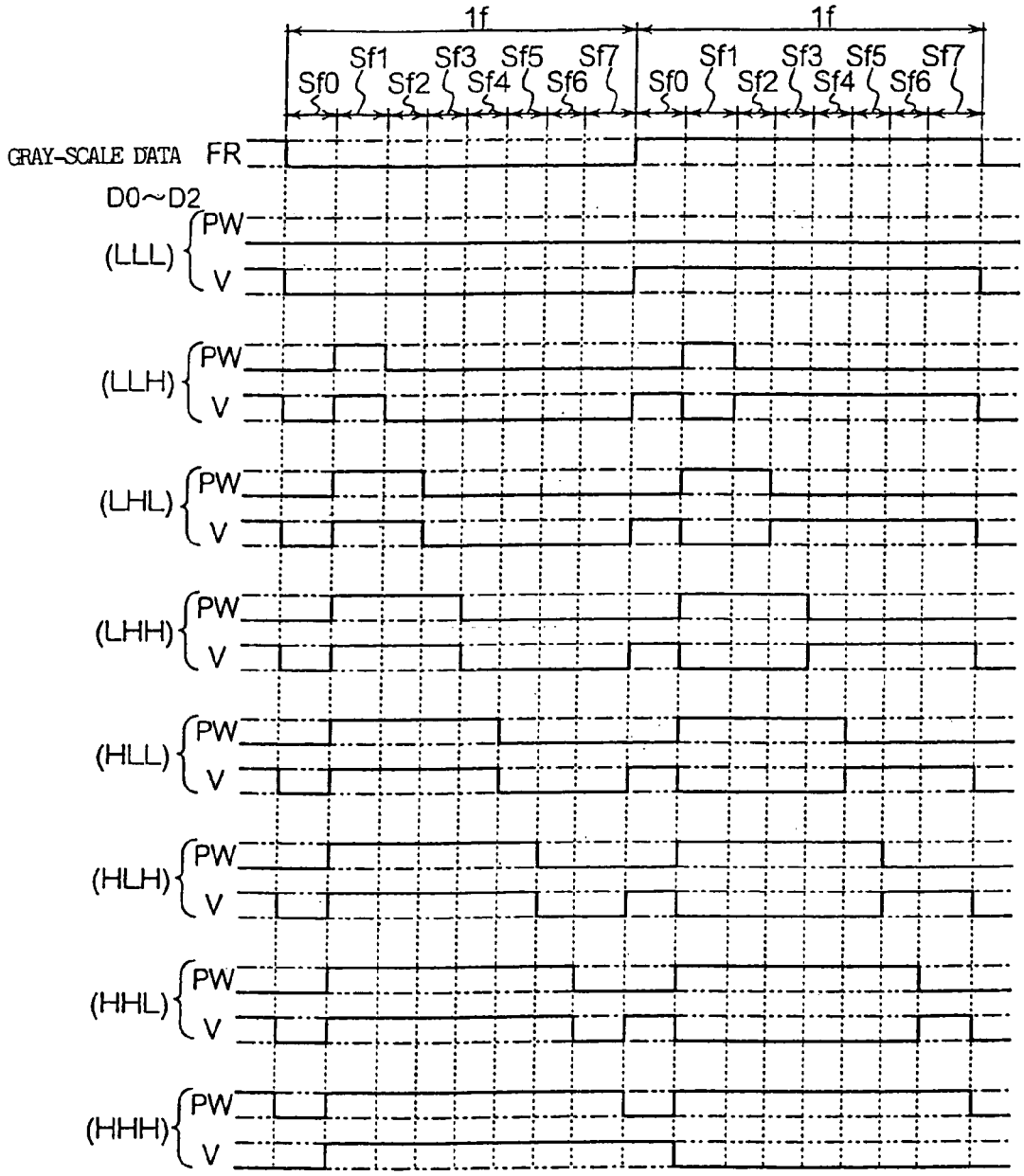
FIG. 15 is a timing chart showing a voltage applied to a pixel electrode in each pixel in the electro-optical device.

Referring to FIG. 15, the voltage, which is applied to the pixel electrode 135 in the pixel 13*b* by outputting from the NOR gate 139*b* the pulse signal PW having the above-described waveform, is described.

For example, when gray-scale data is (LLH), the pulse signal PW is at the H level in the sub-field Sf1. In the other sub-fields, Sf0 and Sf2 to Sf7, the pulse signal PW is at the L level. In this case, the pixel 13*b* is in an on-state only in the sub-field Sf1. Thus, the transmissivity of the pixel 13*b* is 14.3% in accordance with the gray-scale data (LLH).

When gray-scale data is (HHH), the pulse signal PW is at the L level in the sub-field Sf0. In the other sub-fields, Sf1 to Sf7, the pulse signal PW is at the H level. Therefore, in the sub-field Sf0, the pixel 13*b* is in an off-state, while in the other sub-fields, Sf1 to Sf7, the pixel 13*b* is in an on-state. As a result, the transmissivity in accordance with the gray-scale data (HHH) can be obtained.

According to the third embodiment, in addition to the advantages similar to those of the foregoing embodiments, the following advantages can be obtained by providing a sub-field in which the pixel 13*b* is turned off regardless of the gray-scale data.

Figure 16:
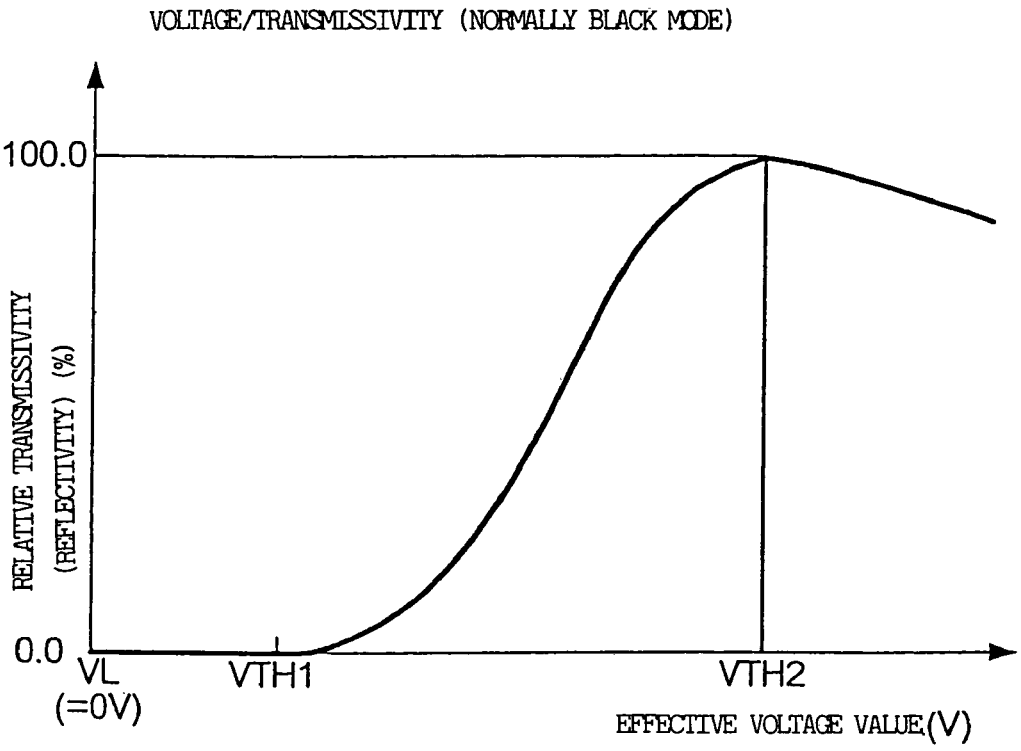
FIG. 16 is a graph of another example of a voltage/transmissivity characteristic of the liquid crystal.

Although an example of a voltage/transmissivity characteristic of the liquid crystal is shown in FIG. 4, not all types of liquid crystal have such a characteristic. In other words, there may be a type of liquid crystal that has a voltage/transmissivity characteristic as shown in FIG. 16. Specifically, when a voltage greater than or equal to the threshold value VTH2 is applied to this liquid crystal, the transmissivity decreases in accordance with the applied voltage.

In the electro-optical device of the second embodiment, when gray-scale data (HHH) is applied, and a voltage that turns on the pixel 13*a* is applied to the pixel 13*a* in all the sub-fields, the effective voltage value applied to the liquid crystal layer in one field may be greater than or equal to the voltage VTH2. When the liquid crystal having the voltage/transmissivity characteristic shown in FIG. 4 is used, no problems occur, even when an effective voltage greater than or equal to the voltage VTH2 is applied, since a transmissivity of 100% can be obtained in accordance with the gray-scale data (HHH). However, when the liquid crystal with the voltage/transmissivity characteristic shown in FIG. 16 is used, and when an effective voltage greater than or equal to the voltage VTH2 is applied, the actual transmissivity falls below 100%, even though the transmissivity must be 100% in accordance with the gray-scale data (HHH). As a result, a problem may occur that a displayed image has a low contrast.

On the other hand, according to the third embodiment, the sub-field Sf0 in which the pixel 13*b* is turned off regardless of if the gray-scale data is provided. By setting the time period of the sub-field Sf0 so that the effective voltage VTH2 is applied to the liquid crystal layer in the pixel 13*b*, when the pixel 13*b* is an on-state in the sub-fields Sf1 to Sf7, excluding the sub-field Sf0, the foregoing problem does not occur. Hence, a transmissivity of 100% can be obtained in accordance with the gray-scale data (HHH). As a result, a displayed image can have a high contrast. The time-period of each of the sub-fields, Sf0 to Sf7, is easily changed by adjusting the period of each gray-scale signal generated by the gray-scale signal generating circuit 23.

According to the third embodiment, the pixel 13*b* is in an off-state in the first sub-field Sf0 in each field. However, the sub-field Sf0 is not required to be at the beginning of a field. The number of such a sub-field in one field is not restricted to one. For example, it is possible to turn off the pixel 13*b* regardless of gray-scale data in a plurality of sub-fields (from among the sub-fields Sf1 to Sf7) in one field.

E: Modifications

Although the embodiments of the present invention have been described hereinabove, the embodiments are only examples and can be modified within the scope of the present invention. Modifications described hereinafter may be conceived.

<Modification 1>

Although it has been described in the above embodiments that timing for inverting the level of the field reverse signal FR is in synchronization with timing for switching the field, it is not necessarily required to do so. Specifically, timing for switching the field reverse signal FR can be completely independent of timing for switching the field. Thus, the period in which the level of the field reverse signal FR is inverted, can be set to a period in which the least amount of flicker is generated. For example, the level of the field reverse signal FR can be inverted every sub-field. Alternatively, the level of the field reverse signal FR can be inverted every few sub-fields within one field. Also, the level of the field reverse signal FR can be inverted with a period differing from that of the field or sub-field. By inverting the level of the field reverse signal FR in this manner, the polarity inversion period of a voltage applied to the liquid crystal layer can be reduced, thereby reducing the amount of flicker. When the level of the field reverse signal FR is inverted with a period shorter than one field, only the polarity of a voltage applied to the liquid crystal 137 is inverted. Thus, the effective voltage applied to the liquid crystal in one field is substantially the same as that in the foregoing embodiments.

<Modification 2>

According to the foregoing embodiments, the field reverse signal FR, whose level is inverted every field, is applied to the counter electrode 136. At the same time, when turning on the pixel 13, the signal/FR, obtained by inverting the level of the field reverse signal FR, is applied to the pixel electrode 135. When turning off the pixel 13, the field reverse signal FR is applied to the pixel electrode 135. As a result, the voltage VH or VL is applied to the liquid crystal layer. However, a method for applying the voltage VH or VL to the liquid crystal layer is not limited to that in the foregoing embodiments. For example, the following method can be used.

In modification 2, a constant voltage Vc is applied to the counter electrode 136, while one of voltages V1, Vc, or V2 is applied to the pixel electrode 135, thereby turning on or off the pixel 13. The voltage V1 is a voltage which is higher than the voltage Vc by the voltage VH. The voltage V2 is a voltage which is lower than the voltage Vc by the voltage VH.

In modification 2, the voltage Vc is applied to the input terminal of the transmission gate 134*a* shown in FIG. 2 (or FIG. 8 or FIG. 12). One of the voltages, V1 or V2, is applied to the input terminal of the transmission gate 134*b* in accordance with the level of the field reverse signal FR. Specifically, when the field reverse signal FR is at the H level, the voltage V1 is applied to the input terminal of the transmission gate 134*b*. When the field reverse signal is at the L level, the voltage V2 is applied to the input terminal of the transmission gate 134*b*.

Figure 17:
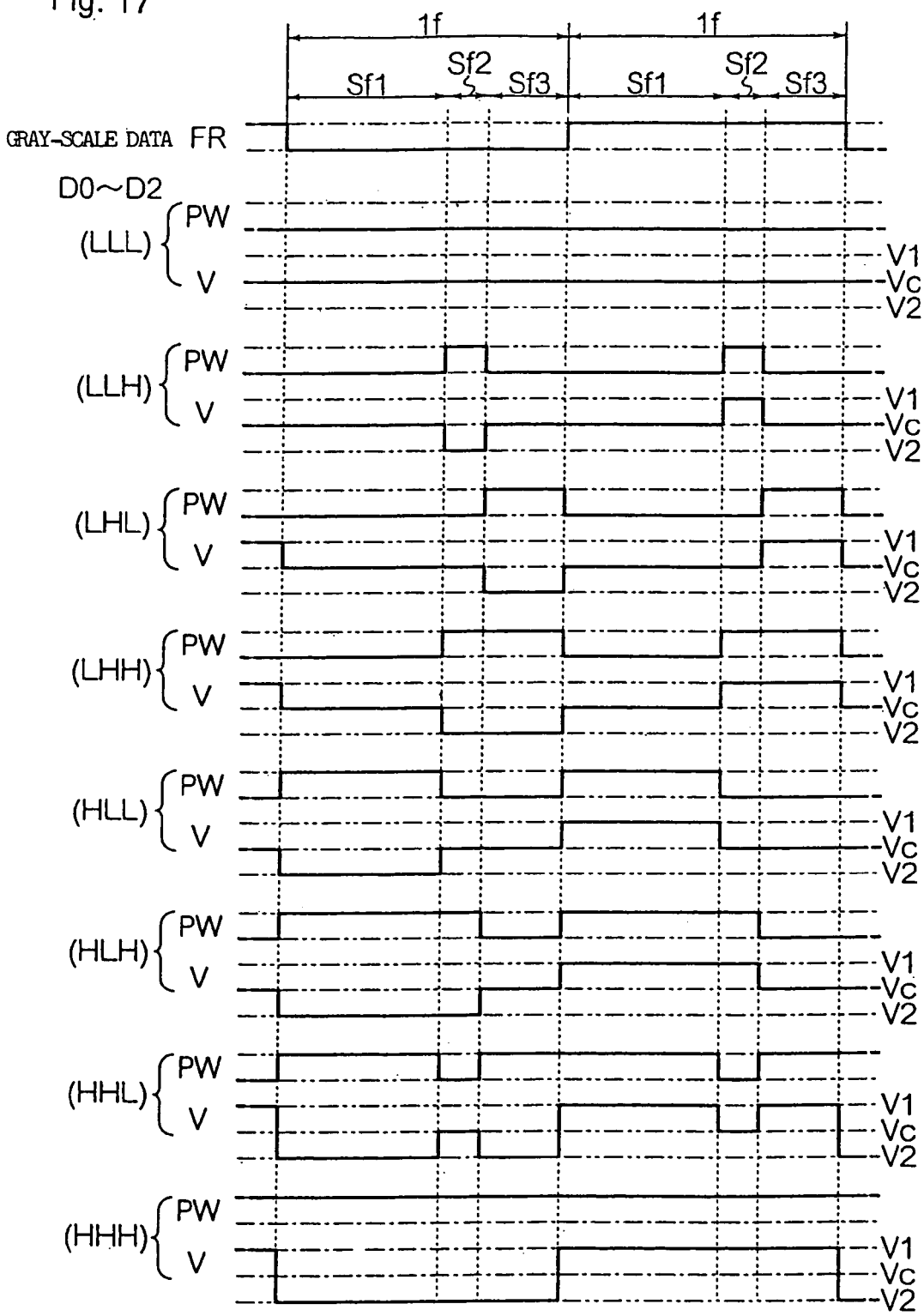
FIG. 17 is a timing chart showing a voltage applied to a pixel electrode in each pixel of an electro-optical device according to a modification of the present invention.

Referring to FIG. 17, the voltage V applied to the pixel electrode 13 in modification 2 is described. FIG. 17 illustrates a voltage applied to the pixel electrode 135 when modification 2 is applied to the electro-optical device according to the first embodiment.

(1) When turning off the pixel 13.

In a sub-field in which the pixel 13 should be turned off, that is, in a sub-field in which the pulse signal PW is at the L level, the transmission gate 134*a* is in an on-state. As a result, the voltage Vc is applied to the pixel electrode 135.

Since the voltage Vc is applied to the counter electrode 136, the voltage applied to the liquid crystal layer of the pixel 13 is VL (=0V), and hence the pixel 13 is turned off.

(2) When turning on the pixel 13.

In a sub-field in which the pixel 13 should be turned on, that is, in a sub-field in which the pulse signal PW is at the H level, the transmission gate 134*b* is in an on-state. As a result, one of the voltages V1 or V2 is applied to the pixel electrode 135 in accordance with the level of the field reverse signal FR. In FIG. 17, it is assumed that the level of the field reverse signal FR is repetitively inverted every field.

Specifically, when turning on the pixel 13, and when the field reverse signal FR is at the H level, the voltage V1 is applied to the pixel electrode 135. As a result, the voltage VH, which is the difference between the voltage V1 and the voltage Vc, is applied to the liquid crystal layer of the pixel 13, thereby turning on the pixel 13. When turning on the pixel 13, and when the field reverse signal FR is at the L level, the voltage V2 is applied to the pixel electrode 135. As a result, the voltage VH, which is the difference between the voltage V2 and the voltage Vc, is applied to the liquid crystal layer of the pixel 13, thereby turning on the pixel 13. The voltage applied to the liquid crystal layer in a field in which the field reverse signal FR is at the H level and the voltage applied to the liquid crystal layer in a field in which the field reverse signal FR is at the L level, have the same absolute value and opposite polarities.

When the method according to modification 2 is employed, as in the foregoing embodiments, application of a DC component to the liquid crystal is prevented. As a result, deterioration of the liquid crystal is prevented. Of course, in modification 2, as in the foregoing modification 1, timing for inverting the level of the field reverse signal FR is not necessarily in synchronization with timing for switching the field or sub-field.

F: Overall Structure of Liquid Crystal Device

Figure 18:
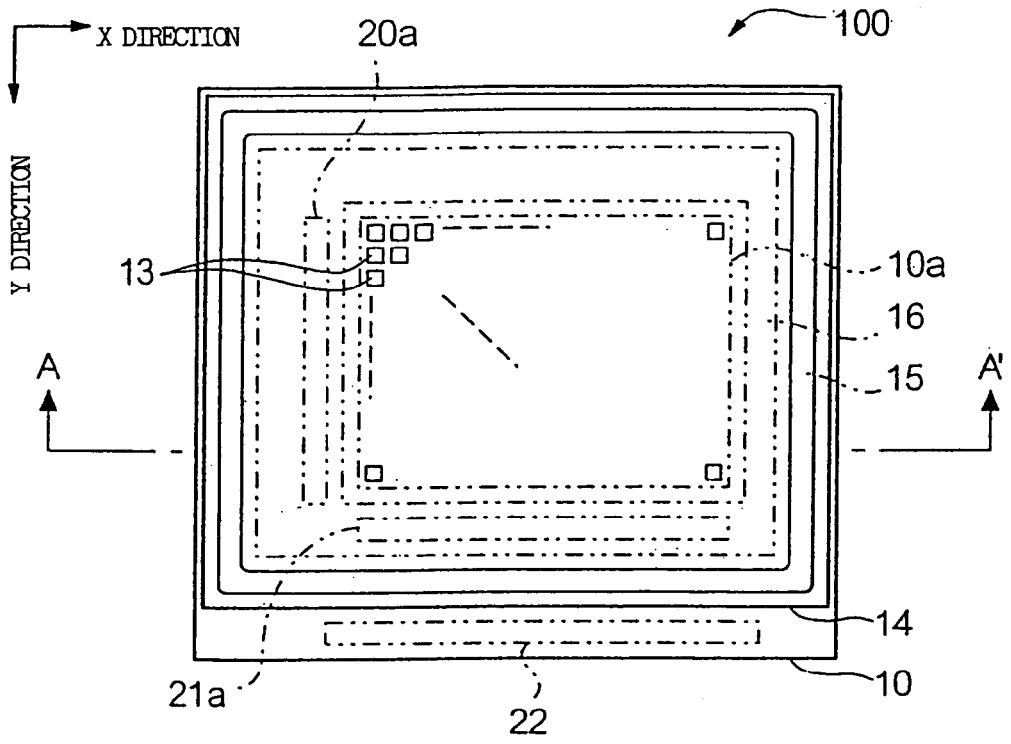
FIG. 18 is a plan view of the structure of an electro-optical device according to the present invention.
Figure 19:
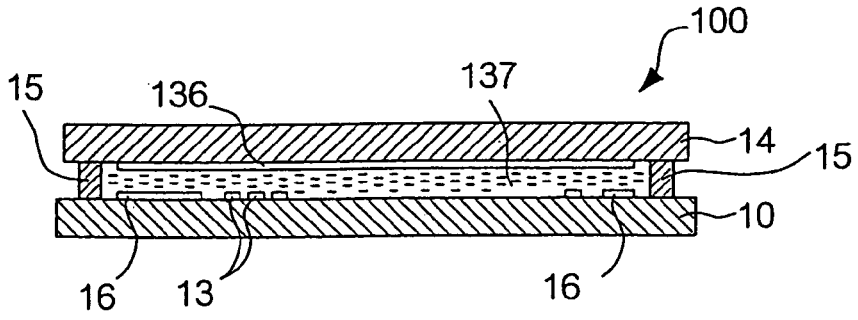
FIG. 19 is a sectional view of the structure of the electro-optical device, taken along line A–A'.

Referring to FIGS. 18 and 19, the structure of the electro-optical device according to the embodiments and modifications will now be described. FIG. 18 is a plan view of the structure of an electro-optical device 100. FIG. 19 is a sectional view taken along the line A–A' in FIG. 18.

As shown in the drawings, the electro-optical device 100 includes a device substrate 10 on which the pixels 13 and the like are formed and an opposing substrate 14 on which the counter electrode 136 and the like are formed. The device substrate 10 and the opposing substrate 14 are bonded with a predetermined gap therebetween by a sealing section 15, and the gap is filled with the liquid crystal 137 as the electro-optical material. In fact, the sealing section 15 has a notch. The liquid crystal 137 is injected through the notch, and subsequently the sealing section 15 is sealed by a sealant (not shown in the drawings).

As described above, when the device substrate 10 is a semiconductor substrate, the device substrate 10 is opaque. For this reason, the pixel electrode 135 in each pixel 13 is formed of reflective metal such as aluminum. As a result, the electro-optical device 100 is used as a reflective-type device. In contrast, the opposing substrate 14 is formed of glass or the like, and hence the opposing substrate 102 is transparent. Needless to say, the device substrate 10 can be formed of a transparent insulating substrate, such as glass. When such an insulating substrate is used, and when the pixel electrode 135 is formed of reflective metal, reflective-type display can be performed. When the pixel electrode 135 is formed of the other material, transmissive-type display can be performed. When the pixel electrode 135 is formed of reflective metal, it is preferable that circuits forming the pixel 13, including the memory cells 130, the gray-sale control circuit 138, and the transmission gates 134*a* and 134*b*, be provided on the opposite side to the observing side with respect to the pixel electrode 135. It thus becomes unnecessary to provide a region between pixel electrodes to form these circuits therein. As a result, an advantage can be obtained that the aperture ratio of each pixel is increased.

On the device substrate 10, a light-blocking film 16 is provided in a region inside the sealing section 15 and outside the display region 10*a*. In the region in which the light-blocking film 16 is formed, for example, the Y address buffer 210 and the Y address decoder 211 are formed in a region 20*a*, and the X address buffer 220, the X address decoder 221, and the sampling/holding circuit 222 are formed in a region 21*a*.

Specifically, the light-blocking film 16 prevents light from entering into the driving circuits formed in these regions. The field reverse signal FR is applied not only to the counter electrode 136 but also to the light-blocking film 16. In the region in which the light-blocking film 16 is formed, a voltage applied to the liquid crystal layer is substantially zero. Hence, the device is in the same display state as the state where no voltage is applied to the pixel electrodes 135.

On the device substrate 10, a plurality of connection terminals are formed in a region 22 outside the region 21*a*, with a separation from the sealing section 15. Control signals (for example, signals supplied to the operation control circuit 20), gray-scale data, and power are input to the region 22 from the outside.

Concerning the counter electrode 136 on the opposing substrate 14, electrical conduction is established with the light-blocking film 16 and the connection terminals on the device substrate 10 by conductive material (not shown) which is provided in at least one corner of four corners at which the substrates are bonded together. In other words, the field reverse signal FR is applied through the connection terminals provided on the device substrate 10 to the light-blocking film 16, and is also supplied to the counter electrode 136 through the conductive material.

In accordance with the usage of the electro-optical device 100, for example, when the electro-optical device 100 is a direct-viewing-type device, first, color filters which are aligned in stripes or in the form of a mosaic or a triangle are provided on the opposing substrate 14. Second, a light-blocking film (black matrix) made of, for example, metal material or resin is formed on the opposing substrate 14. When the usage is to modulate colored light rays, that is, when the electro-optical device 100 is used as a light valve of a projector which will be described below, color filters are not formed. When the electro-optical device 100 is a direct-viewing-type device, a front light unit for irradiating the electro-optical device 100 with light from the opposing substrate 14 side is provided, if necessary. On electrode-forming surfaces of the device substrate 10 and the opposing substrate 14, alignment layers (not shown) which are rubbed in predetermined directions are formed, respectively, defining alignment directions of liquid crystal molecules in the state where no voltage is applied. At the opposing substrate 14 side, a polarizer (not shown) in accordance with the alignment direction is formed. If macromolecular dispersed liquid crystal in which the liquid crystal is dispersed as microparticles in a macromolecule is used as the liquid crystal 137, the above alignment layers and the polarizer become unnecessary. As a result, the efficiency in light utilization is increased. It is therefore advantageous in increasing luminance and reducing power consumption.

As in the embodiments, because the semiconductor substrate is used as the device substrate 10 forming the electro-optical device, it is preferable that the memory cells, the gates and the like in each pixel 13 and components of peripheral circuits be formed of MOSFETs. However, the present invention is not limited to these embodiments. For example, the device substrate 10 can be formed of an amorphous substrate such as glass or quartz. A semiconductor thin film is deposited on this device substrate 10, thereby forming a thin-film transistor (TFT). When the TFT is used, a transparent substrate can be used as the device substrate 10.

Concerning the liquid crystal, various types can be used. In addition to a TN-type, there are an STN (Super Twisted Nematic) type which has a twisted alignment at 180 degrees or greater, a bistable type such as a BTN (Bistable Twisted Nematic) type or a ferroelectric type having memory effects, a macromolecular dispersed type, and a guest-host type. In the guest-host type, a dye (guest), which exhibits anisotropy in visible light absorption between the long axis direction and the short axis direction of the molecules, is dissolved in a liquid crystal (host) whose molecules are aligned in a certain direction, the dye molecules being oriented parallel to the liquid crystal molecules.

Alternatively, a homeotropic alignment structure can be used. In the homeotropic alignment structure, with no voltage applied, the liquid crystal molecules are oriented perpendicular to both substrates, and, when a voltage is applied, the liquid crystal molecules are oriented parallel to both substrates. Also, a homogeneous alignment structure can be used. In the homogeneous alignment structure, with no voltage applied, the liquid crystal molecules are oriented parallel to both substrates, and, when a voltage is applied, the liquid crystal molecules are oriented perpendicular to both substrates. Furthermore, instead of arranging the counter electrode 136 on the opposing substrate 14, it is possible to arrange the pixel electrode 135 and the counter electrode 136 on the device substrate 10, in the form of a comb with a separation therebetween. With this arrangement, the liquid crystal molecules are aligned horizontally, and the alignment direction of the liquid crystal molecules changes in accordance with a horizontal electric field between the electrodes. Accordingly, various types of liquid crystal and alignment modes can be used as long as they are compatible with the driving method of the present invention.

In addition to the liquid crystal device, the electro-optical device can be applied to various electro-optical devices such as devices which perform display employing electro-optical effects by using electroluminescence (EL), digital micromirror device (DMD), plasma emission, and fluorescence caused by electron emission. In such cases, the electro-optical materials include EL materials, mirror device, gas, and fluorescent materials. When an EL material is used as the electro-optical material, the opposing substrate 14 shown in FIGS. 18 and 19 becomes unnecessary because the EL material lies between the pixel electrode 135 and the counter electrode 136 of a transparent conductive film on the device substrate 10. Accordingly, the present invention can be applied to an electro-optical apparatus which has a structure similar to the foregoing structure, and particularly, to all electro-optical apparatuses which perform gray-scale display using pixels which perform on/off (two-level) display.

G: Electronic Apparatus

A few examples of using the above-descried liquid crystal device in specific electronic apparatuses will now be described.

(1) Projector

Figure 20:
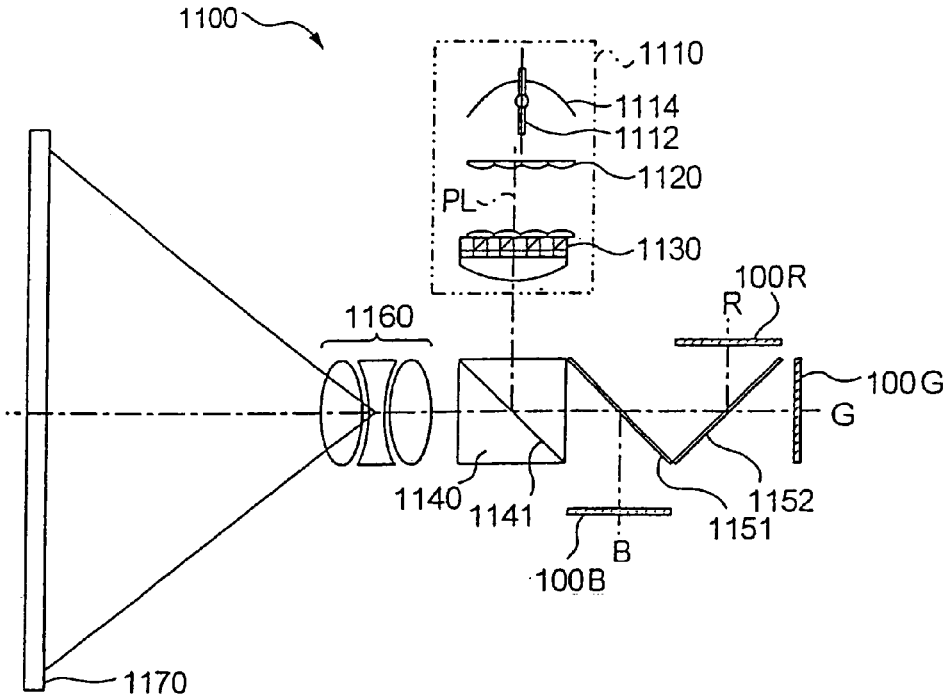
FIG. 20 is a sectional view of the structure of a projector, which is an example of an electronic apparatus to which the electro-optical device is applied.

A projector which uses the electro-optical device according to the embodiments as a light valve is described. FIG. 20 is a plan view of the structure of the projector. As shown in the drawing, a polarizing illumination device 1110 is disposed along a system optical axis PL in the projector 1100. Concerning the polarizing illumination device 1110, light emitted from a lamp 1112 enters a first integrator lens 1120 as luminous fluxes which are substantially parallel to one another by reflection from a reflector 1114. As a result, the light emitted from the lamp 1112 is divided into a plurality of intermediate luminous fluxes. The intermediate luminous fluxes are converted into polarized luminous fluxes of a single type (s-polarized luminous fluxes) in which polarization directions are substantially aligned by a polarization conversion element 1130 which includes a second integrator lens at the light-incident side. The s-polarized luminous fluxes are emitted from the polarizing illumination device 1110.

The s-polarized luminous fluxes emitted from the polarizing illumination device 1110 are reflected by an s-polarized luminous flux reflector 1141 of a polarization beam splitter 1140. Of the reflected luminous fluxes, the blue light flux (B) is reflected by a blue-light reflecting layer of a dichroic mirror 1151, and the reflected light is modulated by a reflective-type electro-optical device 100B. Of the luminous fluxes which pass the blue-light reflecting layer of the dichroic mirror 1151, the red light flux (R) is reflected by a red-light reflecting layer of a dichroic mirror 1152, and the reflected light is modulated by a reflective-type liquid electro-optical device 100R. At the same time, of the luminous fluxes which pass the blue-light reflecting layer of the dichroic mirror 1151, the green light flux (G) passes through the red-light reflecting layer of the dichroic mirror 1152 and is modulated by a reflective-type electro-optical device 100G.

In this manner, red light, green light, and blue light which are modulated by the electro-optical devices 100R, 100G, and 100B, respectively, are sequentially combined by the dichroic mirrors 1152 and 1151 and the polarization beam splitter 1140, and the combined light is projected onto a screen 1170 by a projecting optical system 1160. Since the luminous fluxes corresponding to primary colors R, G, and B enter the electro-optical devices 100R, 100B, and 100G through the dichroic mirrors 1151 and 1152, color filters are unnecessary.

Although the reflective-type electro-optical devices have been used in this embodiment, it is possible to use transmissive-displaying-type electro-optical devices in the projector.

(2) Portable Computer

Figure 21:
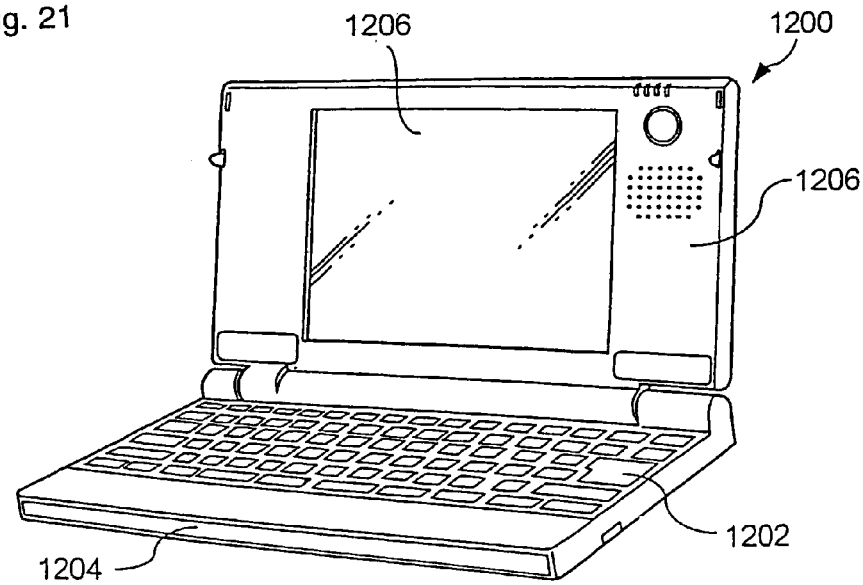
FIG. 21 is a perspective view of the structure of a portable computer, which is an example of an electronic apparatus to which the electro-optical device is applied.

An example in which the above-described electro-optical device is applied to a portable personal computer will now be described. FIG. 21 is a perspective view of the structure of the personal computer. In the drawing, a computer 1200 includes a main unit 1204 including a keyboard 1202 and a display unit 1206. The display unit 1206 includes a front light unit in front of the above-described electro-optical device 100.

With this arrangement, the electro-optical device 100 is used as a reflecting direct-viewing-type device. Concerning the pixel electrodes 135, it is preferable that concavity and convexity be formed so that the reflected light scatters in various directions.

(3) Cellular Phone

Figure 22:
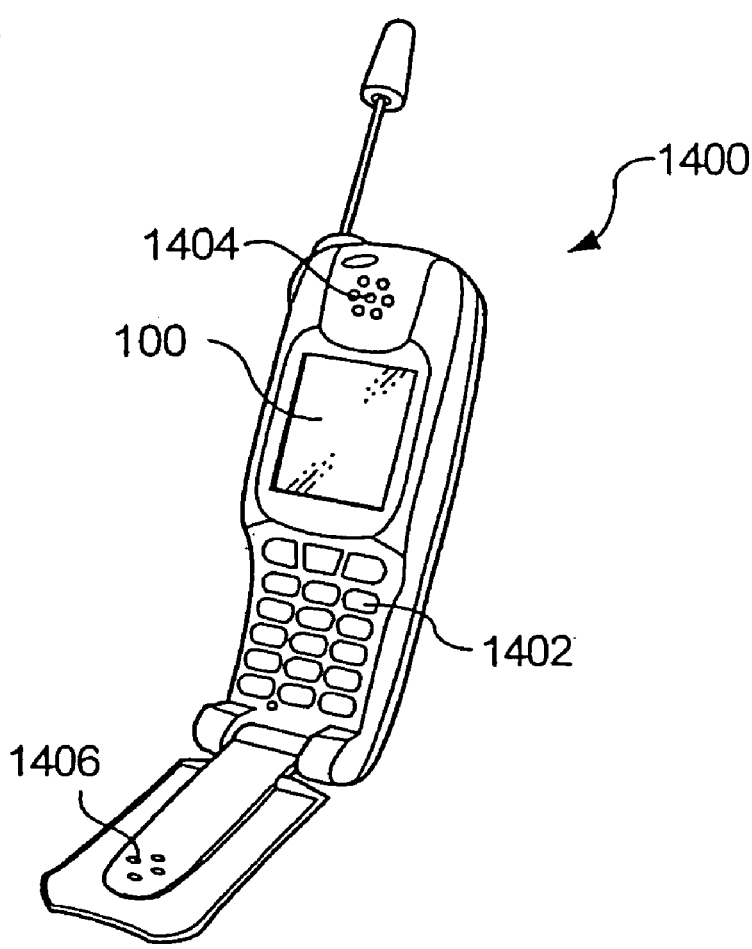
FIG. 22 is a perspective view of a cellular phone, which is an example of an electronic apparatus to which the electro-optical device is applied.

An example in which the above-described electro-optical device is applied to a cellular phone is described. FIG. 22 is a perspective view of the structure of the cellular phone. In the drawing, a cellular phone 1400 includes a plurality of operation buttons 1402, an earpiece 1404, a mouthpiece 1406, and the electro-optical device 100. If necessary, a front light unit is provided in front of the electro-optical device 100. With this arrangement, the electro-optical device 100 is used as a reflecting direct-viewing-type device. Concerning the pixel electrodes 135, it is preferable that concavity and convexity be formed.

Concerning the electronic apparatuses, examples other than those described with reference to FIGS. 20 to 22 may include a liquid crystal television, a viewfinder-type or a monitor-direct-viewing-type video cassette recorder, a car navigation system, a pager, an electronic notebook, an electronic calculator, a word processor, a workstation, a video phone, a POS terminal, and a device with a touch panel. Needless to say, the electro-optical device according to the embodiments and the modifications thereof is applicable to these various types of electronic apparatuses.

As described above, according to the present invention, high-quality gray-scale display can be performed by turning on or off pixels. According to the present invention, each pixel has a memory. In accordance with the result of performing arithmetic processing of gray-scale data stored in the memory and gray-scale signals generated by a gray-scale signal generating circuit, each pixel is turned on or off. It is only necessary to write gray-scale data to a pixel whose gray-scale data has been changed. Thus, the power consumption can be reduced.

What is claimed is:

1. A method for driving an electro-optical device which includes a plurality of pixels including a pixel electrode and a counter electrode which is opposed to the pixel electrode, each pixel including a k-bit memory (where k is a natural number 1, 2, 3, . . . ) that stores k-bit gray-scale data and which performs k-bit gray-scale display in accordance with the k-bit gray-scale data, comprising:

writing gray-scale data to the memory of each pixel;

generating a pulse width signal with a time density in accordance with a comparison result of the gray-scale data written to the memory and k-bit gray-scale signals, wherein the time density corresponds to a voltage duration to accumulate a charge in a liquid crystal layer of the pixel;

applying to said counter electrode a field reverse signal whose polarity is inverted every predetermined period through the pulse width signal; and applying one of either the field reverse signal or a reverse signal having an inverted relationship with a level of the field reverse signal to the pixel electrode in accordance with the pulse width signal.

2. The method for driving an electro-optical device according to claim 1, further including the step of, concerning the k-bit gray-scale signals, setting a selection period of each bit to a time density which implements gray-scale display with $2^0$, $2^1$, $2^2$, . . . , $2^{k-1}$ levels.

3. The method for driving an electro-optical device according to claim 2 further including the steps of:

selecting the gray-scale signal of the corresponding bit from among the gray-scale signals in accordance with the gray-scale data;

generating the pulse width signal by combining the selection periods of the selected gray-scale signals; and applying one of the voltage that turns on the pixel or the voltage that turns off the pixel to the pixel electrode in accordance with the pulse width signal.

4. The method for driving an electro-optical device according to claim 1, further including the steps of:

outputting the k-bit gray-scale signals from a k-bit counter; and setting a period in which each counter value indicated by the output signals is maintained to the time density with which k-bit gray-scale display is implemented.

5. A method for driving an electro-optical device according to claim 4 further including the steps of:

comparing the k-bit gray-scale data with a k-bit counter value based on the gray-scale signals, and generating the pulse width signal in accordance with the comparison result; and applying one of the voltage that turns on the pixel or the voltage that turns off the pixel to a pixel electrode in accordance with the pulse width signal.

6. The method for driving an electro-optical device according to claim 1, the pixel being turned off regardless of a value of the gray-scale data during a period in which the gray-scale signals have a predetermined value.

7. The method for driving an electro-optical device according to claim 1:

the pixel including a pixel electrode and a counter electrode which is opposed to the pixel electrode and to which a predetermined reference voltage is applied; and applying a same voltage which is the same as the reference voltage to the pixel electrode when turning off the pixel in accordance with the pulse width signal; and applying one of either a first voltage higher than the reference voltage or else a second voltage lower than the reference voltage to the pixel electrode while switching between the first and second voltages every predetermined period when turning on the pixel in accordance with the pulse width signal.

8. The method for driving an electro-optical device according to claim 7, the predetermined period being different from the period of each field.

9. The method for driving an electro-optical device according to claim 1, the predetermined period being different from the period of each field.

10. The method for driving an electro-optical device according to claim 1, from among said plurality of pixels, the gray-scale data being written to the memory of the pixel whose gray-scale data stored in the memory thereof needs to be changed.

11. A driving circuit for an electro-optical device including a plurality of groups of column selection lines in which the number of column selection lines is k (where k is a natural number 1, 2, 3, . . . ), a plurality of row selection lines, and a plurality of pixels which are formed corresponding to intersections of the column selection lines and the row selection lines, each pixel including a pixel electrode and a counter electrode which is opposed to the pixel electrode and a k-bit memory that stores k-bit gray-scale data, wherein a pulse width signal with a time density in accordance with a comparison result of the gray-scale data written to the memory and k-bit gray-scale signals in the pixel, and one of either an on voltage that turns on the pixel or an off voltage that turns off the pixel is applied to the pixel electrode in accordance with the pulse width signal, said driving circuit comprising:

a row-selection-line driving circuit that supplies a selection signal to the row selection line that corresponds to the pixel to which the gray-scale data are to be written;

a column-selection-line driving circuit that supplies a signal that corresponds to each bit of the gray-scale data to each column selection line which forms the group of column selection lines corresponding to the pixel to which the gray-scale data are to be written, while the selection signal is being supplied to the row selection line, wherein the time density corresponds to a voltage duration to accumulate a charge in a liquid crystal layer of the pixel; and a generating circuit that supplies a field reverse signal whose level is inverted every predetermined period through the pulse width signal, said field reverse signal applied to said counter electrode and that supplies one of either the field reverse signal or a reverse signal having an inverted relationship with a level of the field reverse signal to the pixel electrode in accordance with the pulse width signal.

12. The driving circuit for an electro-optical device according to claim 11, further comprising a gray-scale signal generating circuit that generates the gray-scale signals.

13. The driving circuit for an electro-optical device according to claim 11, concerning the k-bit gray-scale signals, a selection period of each bit being set to a time density which implements gray-scale display with $2^0$, $2^1$, $2^2$, . . . , $2^{k-1}$ levels.

14. The driving circuit for an electro-optical device according to claim 13:

the gray-scale signal of the corresponding bit being selected from among the gray-scale signals in accordance with the grayscale data;

the pulse width signal being generated by combining the selection periods of the selected gray-scale signals; and one of the voltage that turns on the pixel or the voltage that turns off the pixel being applied to the pixel electrode in accordance with the pulse width signal.

15. The driving circuit for an electro-optical device according to claim 11, wherein the k-bit gray-scale signals being output signals from a k-bit counter, and a period in which each counter value indicated by the output signals is maintained, is set to the time density with which k-bit gray-scale display is implemented.

16. A driving circuit for an electro-optical device according to claim 15:

the k-bit gray-scale data being compared with a k-bit counter value based on the gray-scale signals, and the pulse width signal is generated in accordance with the comparison results; and one of the voltage that turns on the pixel or the voltage that turns off the pixel being applied to the pixel electrode in accordance with the pulse width signal.

17. The driving circuit for an electro-optical device according to claim 11, the pixel being turned off regardless of a value of the gray-scale data during a period in which the gray-scale signals have a predetermined value.

18. The driving circuit for an electro-optical device according to claim 11, said row-selection-line driving circuit being formed on a predetermined substrate on which the pixels are formed.

19. The driving circuit for an electro-optical device according to claim 11, said column-selection-line driving circuit being formed on a predetermined substrate on which the pixels are formed.

20. The driving circuit for an electro-optical device according to claim 11, further comprising a writing circuit that writes the gray-scale data to the memory of the pixel, from among the pixels, whose gray-scale data stored in the memory thereof needs to be changed.

21. The driving circuit for an electro-optical device according to claim 11, further comprising a reading circuit that reads the gray-scale data stored in the memory of the pixel.

22. The driving circuit for an electro-optical device according to claim 11:

the pixel including a pixel electrode and a counter electrode which is opposed to the pixel electrode and to which the reference voltage is applied whose polarity is inverted every predetermined period;

when turning on the pixel in accordance with the pulse signal, an opposite voltage which is the opposite polarity as the reference voltage being applied to the pixel electrode; and when turning off the pixel in accordance with the pulse signal, a same voltage which is the same polarity as the reference voltage being applied to the pixel electrodes.

23. The driving circuit for an electro-optical device according to claim 22, the predetermined period being different from the period of each field.

24. The driving circuit for an electro-optical device according to claim 11:

the pixel including a pixel electrode and a counter electrode which is opposed to the pixel electrode and to which the reference voltage is applied;

when turning off the pixel in accordance with the pulse signal, a same voltage which is the same as the reference voltage being applied to the pixel electrode; and when turning on the pixel in accordance with the pulse signal, one of either a first voltage higher than the reference voltage or else a second voltage lower than the reference voltage being applied to the pixel electrode while switching between the first and second voltages every predetermined period.

25. The driving circuit for an electro-optical device according to claim 24, the predetermined period being different from the period of each field.

26. The driving circuit for an electro-optical device according to claim 11, from among said plurality of pixels, the gray-scale data being written to the memory of the pixel whose gray-scale data stored in the memory thereof needs to be changed.

27. An electro-optical device which includes a plurality of pixels and which performs k-bit gray-scale display in accordance with k-bit gray-scale data (where k is a natural number 1, 2, 3, . . . ), comprising:

a plurality of groups of column selection lines, in which the number of column selection lines is k;

a plurality of row selection lines;

a plurality of pixels formed corresponding to intersections of the column selection lines and the row selection lines, each pixel including:

a pixel electrode, a counter electrode which is opposed to the pixel electrode that applies to said counter electrode a field reverse signal whose polarity is inverted every predetermined period, a k-bit memory that stores the k-bit gray-scale data, and a pixel driving circuit that generates a pulse width signal with a time density in accordance with a comparison result of the gray-scale data written to the memory and k-bit gray-scale signals and that applies one of either the field reverse signal or a reverse signal having an inverted relationship with a level of the field reverse signal to the pixel electrode in accordance with the pulse width signal, wherein the time density corresponds to a voltage duration to accumulate a charge in a liquid crystal layer of the pixel;

a row-selection-line driving circuit that supplies a selection signal to the row selection line that corresponds to the pixel to which the gray-scale data are to be written; and a column-selection-line driving circuit that supplies the gray-scale data to each column selection line which forms the group of column selection lines corresponding to the pixel to which the gray-scale data are to be written, while the selection signal is being supplied to the row selection line.

28. The electro-optical device according to claim 27, the memory comprising:

a switching device which is turned on by the selection signal; and two inverters that write the gray-scale data which is supplied to the corresponding column selection line when the switching device is turned on and that maintain the written gray-scale data when the switching device is turned off, wherein the output of one inverter is the input of the other inverter.

29. The electro-optical device according to claim 27, further comprising a gray-scale signal generating circuit that generates the gray-scale signals.

30. The electro-optical device according to claim 27, wherein, concerning the k-bit gray-scale signals, a selection period of each bit being set to a time density which implements gray-scale display with $2^0, 2^1, 2^2, \ldots, 2^{k-1}$ levels.

31. The electro-optical device according to claim 27, wherein:

the k-bit gray-scale signals being output signals from a k-bit counter, and a period in which each counter value indicated by the output signals is maintained is set to the time density with which k-bit gray-scale display is implemented.

32. The electro-optical device according to claim 27, the pixel driving circuit comprising:

a pulse duration control circuit that compares the k-bit gray-scale data with a k-bit counter value based on the gray-scale signals and that generates the pulse signal in accordance with the comparison result; and a switching circuit that applies one of the voltage that turns on the pixel or the voltage that turns off the pixel to the pixel electrode in accordance with the pulse signal generated by the pulse duration control circuit.

33. The electro-optical device according to claim 27, the pixel being turned off regardless of a value of the gray-scale data during a period in which the gray-scale signals have a predetermined value.

34. The electro-optical device according to claim 27, said row-selection-line driving circuit being formed on a predetermined substrate on which the pixels are formed.

35. The electro-optical device according to claim 27, said column-selection-line driving circuit being formed on a predetermined substrate on which the pixels are formed.

36. The electro-optical device according to claim 27, further comprising a writing circuit that writes the gray-scale data to the memory of the pixel, from among the pixels, whose gray-scale data stored in the memory thereof needs to be changed.

37. The electro-optical device according to claim 27, further comprising a reading circuit that reads the gray-scale data stored in the memory of the pixel.

38. The electro-optical device according to claim 27, the memory and the pixel driving circuit each including a switching device; and at least one of the switching devices included in the memory or the pixel driving circuit is formed of a thin film transistor formed on an insulating substrate.

39. The electro-optical device according to claim 27, the memory and the pixel driving circuit each including a switching device; and at least one of the switching devices included in the memory or the pixel driving circuit is formed on a semiconductor substrate.

40. The electro-optical device according to claim 27, the pixel electrode being reflective.

41. The electro-optical device according to claim 27, at least one of the memory or the pixel driving circuit being formed on the opposite side to the observing side with respect to the pixel electrode.

42. The electronic apparatus comprising an electro-optical device as set forth in claim 27.

43. The electro-optical device according to claim 27:

the pixel including a pixel electrode and a counter electrode which is opposed to the pixel electrode;

when turning on the pixel in accordance with the pulse signal, an opposite voltage which is the opposite polarity as the reference voltage being applied to the pixel electrode; and when turning off the pixel in accordance with the pulse signal, a same voltage which is the same polarity as the reference voltage being applied to the pixel electrodes.

44. The electro-optical device according to claim 43, the predetermined period being different from the period of each field.

45. The electro-optical device according to claim 27:

the pixel including a pixel electrode and a counter electrode which is opposed to the pixel electrode and to which the reference voltage is applied;

when turning off the pixel in accordance with the pulse width signal, a same voltage which is the same as the reference voltage being applied to the pixel electrode; and when turning on the pixel in accordance with the pulse width signal, one of either a first voltage higher than the reference voltage or else a second voltage lower than the reference voltage being applied to the pixel electrode while switching between the first and second voltages every predetermined period.

46. The electro-optical device according to claim 45, the predetermined period being different from the period of each field.

47. The electro-optical device according to claim 27, from among said plurality of pixels, the gray-scale data being written to the memory of the pixel whose gray-scale data are stored in the memory thereof needs to be changed.

* * * * *